US010376079B2

(12) United States Patent
Jensen

(10) Patent No.: US 10,376,079 B2
(45) Date of Patent: Aug. 13, 2019

(54) NECK SUPPORT PILLOW

(71) Applicant: Gemma Jensen, Cheshire (GB)

(72) Inventor: Gemma Jensen, Cheshire (GB)

( * ) Notice: Subject to any disclaimer, the term of this patent is extended or adjusted under 35 U.S.C. 154(b) by 0 days.

(21) Appl. No.: 15/550,307

(22) PCT Filed: Feb. 15, 2016

(86) PCT No.: PCT/GB2016/050368

§ 371 (c)(1),
(2) Date: Aug. 10, 2017

(87) PCT Pub. No.: WO2016/128777

PCT Pub. Date: Aug. 18, 2016

(65) Prior Publication Data

US 2018/0055252 A1 Mar. 1, 2018

(30) Foreign Application Priority Data

Feb. 13, 2015 (GB) ..... 1502493.8

(51) Int. Cl.
*A47G 9/10* (2006.01)

(52) U.S. Cl.
CPC .... *A47G 9/1081* (2013.01); *A47G 2009/1018* (2013.01)

(58) Field of Classification Search
CPC ..... A47G 9/0253; A47G 9/1081; A47G 9/10; A47G 2009/1018
See application file for complete search history.

(56) References Cited

U.S. PATENT DOCUMENTS 1,380,480 A * 6/1921 Jennings ..... A47C 7/383 5/490
2,412,769 A * 12/1946 Easterbrooks ..... A47G 9/0253 5/485
2,500,250 A * 3/1950 Hill ..... A47G 9/0253 297/220
3,267,496 A * 8/1966 Gionet ..... A47G 9/0253 5/490
4,712,259 A * 12/1987 Chiasson ..... A47G 9/0253 5/490
4,754,513 A * 7/1988 Rinz ..... A47G 9/0253 5/485
5,240,330 A * 8/1993 Thompson ..... A45C 9/00 224/577

(Continued)

FOREIGN PATENT DOCUMENTS

WO 03/001951 A1 1/2003

*Primary Examiner* — Eric J Kurilla
(74) *Attorney, Agent, or Firm* — Craft Chu PLLC; Andrew W. chu

(57) ABSTRACT

The neck support pillow includes a main pillow body and a neck support member releasably engaged to the main pillow body. The neck support member includes a first body portion covering at least part of a first face of the main pillow body adjacent an edge of the main pillow body for supporting the neck in use and a second body portion extending from the first portion over the edge of the main pillow body towards a second face of the main pillow body. The neck support member provides a raised surface relative to the main pillow body surface for supporting the neck in use. Neck support members and uses of the neck support members are also described.

15 Claims, 7 Drawing Sheets

(56) References Cited

U.S. PATENT DOCUMENTS 5,271,114 A * 12/1993 Kjersem ..... A47G 9/0253 5/490
5,572,753 A * 11/1996 Ruscitto ..... A47G 9/0253 112/475.08
5,802,644 A * 9/1998 Scheurer ..... A47G 9/10 5/640
6,023,798 A * 2/2000 Hui ..... A47G 9/10 5/482
6,895,619 B1 * 5/2005 Lee ..... A47G 9/10 5/630
7,089,617 B1 * 8/2006 Lauro ..... A47G 9/0253 5/490
7,971,294 B1 * 7/2011 Murauskos ..... A47G 9/0253 5/489
D660,069 S * 5/2012 Beuerle ..... A47G 9/0253 D21/658
8,707,485 B1 4/2014 Conley
9,833,082 B1 * 12/2017 Rutkowski ..... A47G 9/0253
9,833,087 B1 * 12/2017 Richardson ..... A47G 9/10
2005/0177941 A1 * 8/2005 Miller ..... A47G 9/0253 5/490
2006/0048300 A1 * 3/2006 DiGirolamo ..... A47G 9/1081 5/645
2009/0089936 A1 * 4/2009 Shelby ..... A47C 27/00 5/733
2011/0061166 A1 * 3/2011 Liu ..... A47G 9/0253 5/636
2011/0271453 A1 * 11/2011 Gandhi ..... A47G 9/1081 5/640
2012/0079657 A1 * 4/2012 Holyfield ..... A47G 9/0253 5/490
2012/0186016 A1 * 7/2012 Martin ..... A47C 31/11 5/490
2013/0042410 A1 * 2/2013 Bice ..... A47G 9/007 5/490
2013/0269111 A1 * 10/2013 Berg ..... A47G 9/1027 5/644
2014/0020184 A1 * 1/2014 Loth ..... A47G 9/1081 5/640
2014/0230151 A1 * 8/2014 Kim ..... A47G 9/1081 5/640
2015/0026891 A1 * 1/2015 Davis ..... A47C 20/021 5/636
2015/0040321 A1 * 2/2015 Moore ..... A47G 9/1009 5/636
2015/0047646 A1 * 2/2015 Marinkovic ..... A61H 1/008 128/845
2015/0230635 A1 * 8/2015 Abrams ..... A47G 9/1081 5/636
2017/0042350 A1 * 2/2017 Mittal ..... A47G 9/10
2018/0008064 A1 * 1/2018 Dudonis ..... A47G 9/0253

* cited by examiner

NECK SUPPORT PILLOW

CROSS-REFERENCE TO RELATED APPLICATIONS

See Application Data Sheet.

STATEMENT REGARDING FEDERALLY SPONSORED RESEARCH OR DEVELOPMENT

Not applicable.

THE NAMES OF PARTIES TO A JOINT RESEARCH AGREEMENT

Not applicable.

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

Not applicable.

STATEMENT REGARDING PRIOR DISCLOSURES BY THE INVENTOR OR A JOINT INVENTOR

Not applicable.

BACKGROUND OF THE INVENTION

1. Field of the Invention

The present invention relates to pillows, particularly pillows that provide additional support to the neck during sleep, and to neck support members for use in forming such pillows.

2. Description of Related Art Including Information Disclosed Under 37 CFR 1.97 and 37 CFR 1.98

Bed pillows come in a wide variety of forms. Conventional bed pillows are typically fabric enclosures containing a filler material. Such filler materials include feathers, down, synthetic polymer fibres, foam chips, memory foam and solid latex.

It is widely accepted that conventional pillows fail to provide adequate support to the neck, particularly to the cervical vertebrae, during sleep. This is because when a person lies down with their head on the pillow and the head is placed in a neutral position relative to their body, a gap is formed between their neck and the mattress/pillow edge. The gap that is formed between the neck and the mattress when the head is in a neutral position relative to the spine is greater than the gap formed between the head and mattress. This is the case whether the person is lying on their side or on their back. Usually, the filler material of a pillow is displaced or substantially flattened by the weight of the head and neck, meaning that the head and neck are largely displaced from a neutral position.

Conventional pillows do not adequately compensate for the difference of height between the neck and mattress as typically, there is less padding at the pillow edge in the region of the neck than at the middle portion of the pillow where the head is placed. This therefore provides very little support for the neck.

The lack of neck support provided by conventional pillows can lead to neck, shoulder and back pain due to the neck adopting an unnatural posture during sleep, misaligning the spine and placing persistent strain on a vulnerable area of the body, particularly when the subject is sleeping on their side, where the gap between neck and mattress/pillow edge is greatest.

Various products have been marketed purporting to address the problem of lack of support in the neck region. These products typically aim to provide an additional structural support for the neck compared to conventional pillows. These products typically fall into two categories, i.e. pillows having additional neck support permanently integrated into the pillow design (e.g. contoured memory foam pillows) and supplementary neck supports, which are separate accessory items intended to be used in combination with a pillow to form a multi-part pillow.

Integrated Support Pillows

A proposed approach in the field has been to provide integrated support pillows, such as contoured pillows (e.g. orthopaedic pillows) which include a neck support function integrated into the pillow body. This function is typically provided by including an integrated, curved portion at an edge of the pillow designed to mimic and support the natural curvature of the neck. There are many products on the market which offer variations on this approach.

US 20140075677 desribes a contoured inflatable neck support pillow having a central head-resting depression (feature 15 in FIG. 1 of US 20140075677) and an integrated neck support (feature 20 in FIG. 1 of US 20140075677).

US20010018777 describes an orthopaedic pillow having a number of integrated components of varying densities, including a rectangular foam core 10 containing a cushion layer 40 and an integrated layer of foam 50 wrapped around the core.

WO2013/013777A describes a medical travel pillow that contains an integrated neck roll contained in a part of the pillow that is isolated from the main pillow body Other developments have also been proposed based on the conventional integrated contoured pillow. For instance, CN202843108U describes a nursing pillow that provides thermal therapy for the shoulders and neck. The nursing pillow includes an integrated contoured main pillow body having a conventionally-shaped upper pillow surface for providing support to the neck and head, and a supplementary device for use with the main pillow containing an internal heating element to heat the shoulders and neck. The supplementary heating device and main pillow surface are specifically configured with complementary features designed to releasably interlock. The supplementary heating device has a curved arc portion that is adapted to accept the contoured edge of the main pillow body and provide surface contact between the heating element and the neck, a flat base portion for placement under the main pillow body edge and a concave outer surface portion defining a ramp on which the upper back or shoulders are placed in use. This pillow is intended for active therapy of a subject lying on their back. The nursing pillow body has a cutaway portion in the lower surface for receiving a complementary projecting portion of the supplementary heating device and additional complementary male and female portions meaning that each portion of the nursing pillow is interdependent on the specific complementary portion such that neither the main pillow nor the supplementary heating device would be particularly suited for general use with other non-tailored complementary pillows or heating devices. Moreover, the provision of an upper back/shoulder ramp means that the utility of the nursing pillow is principally restricted to therapy of a subject lying on their back.

Integrated support pillows, such as contoured memory foam pillows come in a predefined geometric shape and typically the filler material, whilst being able to somewhat conform to the user's head and/or neck, cannot usually be readily shaped, plumped or moulded to support a wide variety of sleeping positions or body types. In particular, differences in neck length can significantly affect comfort levels. These pillow types have little flexibility and the pillow's thickness cannot usually be readily adjusted as the filler material is typically not moveable within the pillow. A common criticism of solid memory foam pillows for instance is that they are too hard, rigid or heavy. Another problem is that the resulting curved shape of the pillow is predefined and integrated to match the curvature of the neck when the user is on their side, or back. As the curvature of the neck can differ between users, and the curvature varies depending on whether a user is lying on their side, front or back, a fixed curvature with little flexibility and too much rigidity can lead to discomfort in certain positions. Many contoured pillows on the market have one edge provided with a larger curvature (intended to target side sleeping) and an opposing edge with a smaller curvature (intended to target back sleeping). However, the user's neck length can determine which side is preferred and whether a given side is preferred for side sleeping or back sleeping. It is therefore desirable to provide neck support pillows that are more comfortable for the end-user.

Another variable which the user must consider is mattress hardness. A pillow having a fully integrated neck support, e.g. contour feature, can have a different feel and function depending on how much the mattress deforms under a user's body during rest/sleep. In general, it is difficult for a user to find an integrated neck support product that matches their preferences for head and neck comfort and choice of mattress. This means that if only one of the head portion and the neck portion is satisfactory for the user, the entire integrated product must be replaced. Not only does this incur significant expense to the user, it makes choosing a pillow having the right combination of features more difficult. Moreover, the entire integrated product must be taken with the user when they travel.

Various filler materials have been proposed for such pillows including conventional foam, air (in the case of inflatable pillows) and viscoelastic materials, e.g. memory foam. A pillow made solely from these materials, e.g. memory foam, can provide a different density, feel and comfort to the user compared to conventional bed pillows, which may be undesirable to some. Also, inflatable contour pillows and contour pillows made from solid foam often do not provide opportunity for air to circulate, meaning that these pillows can trap heat and cause uncomfortable sweating for the user when sleeping. Some pillows have holes punched into the body to allow for better air circulation in an attempt to mitigate this problem, but the downside of this is that it weakens the density of the pillow and therefore offers less support.

Supplementary Supports

Another approach has been to provide supplementary neck supports, such as cylindrical neck rolls, which are intended to be used in combination with a main pillow, e.g. a conventional bed pillow, to boost support in the neck region.

US 2010077551 A describes the use of cylindrical neck rolls that can be inserted into elongated pockets in a tailored pillow case.

WO2012/164109A1 describes a contoured pillow provided with a supplementary upper back support wedge that is provided adjacent to and abutting the pillow (see feature 1 of FIG. 1 of WO2012/164109A1). The separate wedge and pillow are enveloped by a tailored pillowcase (features 2, 3 and 5 in FIG. 1 of WO2012164109A1). In this case the neck support is provided by an integrated contour pillow and the supplementary wedge provides upper back support.

WO95/28861A1 describes a pillow comprising two separate parts, i.e. a neck support insert, and a pillow body for supporting the head. The support insert occupies a section of a tailored pillowcase separated from the remaining pillow part by means of an internal wall.

JP2010-088548 describes a pillow including a main pillow for mounting the user's head, and an auxiliary pillow disposed to overlap with a portion of the top face of the main pillow and which is connected to the main pillow body for mounting the user's neck. The auxiliary pillow is substantially flat and is thus tailored to back sleeping.

Such supplementary support devices often provide a marked contrast in feel, density and support between the supplementary portion and the main pillow, which is exacerbated by the disconnect between the two parts. This can lead to the support and main pillow feeling like two separate entities, which can be uncomfortable for some users. Supplementary supports are also prone to moving relative to the pillow as the user moves during sleep, resulting in them becoming displaced and ineffective. To mitigate this movement, products have been proposed having means to physically attach the supplementary support to the pillow. For instance, WO95/28861A1 and WO2013/013777A1 describe tailored pillow cases that envelop the supplementary support and pillow individually to isolate the support and reduce movement, and JP2010-088548 describes the use of a pivotable connection between the pillow and supplementary support. However, these proposed solutions add an additional layer of complexity to the product design, add an additional level of impracticality for the end user, and require a close level of compatibility between the pillow, supplementary support and the pillow case design, meaning that these products offer limited flexibility for the end-user. If, for instance, the end-user lost or damaged a tailored pillow-case designed specifically for containing a certain supplementary support, this may render the resulting supplementary support ineffective and thus redundant.

There is therefore a need to provide products for providing supporting to the neck region during rest/sleep that mitigate or obviate one or more of the problems mentioned above.

The present invention obviates or mitigates one or more problems associated with prior art pillows, as identified above.

BRIEF SUMMARY OF THE INVENTION

At its most general, the present invention proposes that by providing a neck support member for a pillow that can releasably engage and at least partially wrap around or encase an edge of a bed pillow, a neck support function can be added to any bed pillow, i.e. including conventional bed pillows. This arrangement provides a number of advantages.

Releasable Engagement

By releasably engaging the main pillow body, it is meant that neck support members of the present disclosure are adapted to contact the main pillow body to provide a temporary engagement, i.e. wherein the neck support member, once engaged with the main pillow, can be readily disengaged (e.g. for replacement, transport or cleaning).

By using neck support member of the present disclosure to releasably engage with a main pillow body, the neck support member may be used to form a neck support pillow by combining the neck support member with a main pillow of any suitable type according to the user's preference, such as a conventional bed pillows. Thus, the neck support members of the present invention have the advantage that they do not need to be used with a pillow specifically tailored to the shape of the neck support member. By using a neck support member of the present disclosure with a user's own pillow of choice, the user can add a supportive function to the neck whilst keeping the familiar comfort of their usual pillow, providing a neck support pillow having improved overall comfort for the user.

The present invention allows the user to easily interchange the neck support member according to their preference. Thus, the user may interchange more or less supportive neck support members depending on the desired outcome (e.g. whether the intended use is mainly orthopaedic or simply to provide additional comfort), or to match the product according to different main pillows and mattress types, without having to replace the entire pillow.

The neck support member of the invention is portable and can conveniently be carried in a suitcase for use when travelling. The ready interchangeability of neck support members of the present invention means that the user has the option, when travelling, of transporting only the neck support member with the intention of combining it with another main pillow body at the travel destination (e.g. hotel) meaning that the user need not transport the entire main pillow body itself.

Because the neck support member extends around the pillow edge, it is able to wrap around (or at least partially encase) the pillow edge, meaning that the product also feels more like an integrated neck support product compared to other supplementary neck support products that simply abut against, or are placed on top of, the main pillow body, such as neck rolls. Also, because the edge of the main pillow is encased or 'sandwiched' inside the recess/cavity of the neck support member, the structural support of the pillow body itself contributes to the overall neck support provided when the neck support member of the present disclosure is used to form a neck support pillow of the present disclosure. This means that a surprisingly effective neck support function can be provided by the neck support members of the present invention with relatively little additional thickness being added by the neck support member itself (compared for instance to cervical neck rolls that add a large amount of addition bulk).

Whilst a tailored pillow case is not needed to retain the neck support member of the present invention in position on the main pillow body in use, the neck support member may conveniently be encased together with the main pillow body in a conventional pillow case if desired for aesthetic purposes. Because the neck support member suitably wraps around (or at least partially encases) the pillow, it suitably takes up less room inside a pillow case compared with, say, cervical rolls, that either sit on top of the pillow or alongside it. Moreover, if room is already limited inside a pillowcase, the addition of a prior art cervical roll tends to cause the main pillow to become deformed to compensate, which will affect its function and feel. This problem is mitigated by the present invention due to the nature in which the neck support extends over the pillow edge to wrap around/encase the pillow edge.

A number of other advantages of the invention will be apparent to the skilled person on reading the present disclosure, which is described in further detail below.

The present disclosure thus generally proposes a neck support pillow comprising a main pillow body and a neck support member releasably engaged to the main pillow body, the neck support member having a neck support portion covering at least part of a face of the main pillow body and extending over an edge of the main pillow body providing a raised surface at the edge of the main pillow body relative to the main pillow body surface.

For instance, a neck support pillow may be provided comprising a main pillow body and a neck support member releasably engaged to the main pillow body, the neck support member having a neck support portion covering at least part of a first face of the main pillow body and extending over an edge of the main pillow body towards a second face of the main pillow body, providing a raised surface at the edge of the main pillow body relative to the main pillow body surface and having a body thickness at the edge of the main pillow body suitable for supporting the neck in use.

Thus, the present disclosure suitably provides a neck support pillow comprising a main pillow body and a neck support member releasably engaged to the main pillow body, the neck support member comprising a first body portion covering at least part of a first face of the main pillow body adjacent an edge of the main pillow body for supporting the neck in use and a second body portion extending from the first portion over the edge of the main pillow body towards a second face of the main pillow body, the neck support member providing a raised surface relative to the main pillow body surface for supporting the neck in use, wherein:

a) the first body portion of the neck support member comprising an elongate body portion extending over the first main pillow body face away from the edge of the main pillow body to cover at least part of the first face of the main pillow body and configured such that at least part of the elongate member extends underneath at least part of the user's head when the user's head and neck is placed on the pillow in use and/or the second body portion of the neck support member comprises an elongate body portion extending over the second main pillow body face away from the edge of the main pillow body to cover at least part of the second face of the main pillow body and configured such that at least part of the elongate member extends underneath at least part of the user's head when the user's head and neck is placed on the pillow in use; and/or b) the parts of the neck support member adjacent the edge of the main pillow body and extending over the edge of the main pillow body that are configured to contact a subject in use have a curved outer surface profile that is substantially convex (i.e. outwardly curved); and/or c) the neck support member providing a raised surface relative to the main pillow body surface for supporting the neck in use, wherein the outer surface of the second body portion projects in a direction directly away from the main pillow body no more than about 10 cm from the main pillow body edge (i.e. toward the user); and/or d) the neck support member has an outer surface and an inner core, the core consisting essentially of one or more deformable materials.

The present disclosure also suitably provides a neck support member for use in supporting the neck, the neck support member configured so as to be releasably engageable with an edge of a main pillow body, the neck support member having a first body portion and a second body portion extending from an end of the first body portion, the first body portion configured (i.e. shaped) so as to be useable to cover at least part of a first (e.g. head-contacting) face of a main pillow body adjacent an edge of the main pillow body; and the second body portion disposed relative to the first body portion so as to be useable to extend over the edge of the main pillow body from the first body portion toward the second pillow face, wherein the first and second body portions, when disposed as such in use, provide a raised surface relative to the main pillow body surface for supporting the neck, wherein:

a) the first body portion of the neck support member comprises an elongate body portion configured relative to the first and second body portions so as to be useable when the neck support member is engaged to a main pillow edge to extend over a face of the main pillow body to cover at least part of a first face of the main pillow body adjacent the pillow edge and configured so as to be useable such that at least part of the elongate member extends underneath at least part of the user's head when the user's head and neck is placed on the pillow in use, and/or wherein the second body portion of the neck support member comprises an elongate body portion configured relative to the first and second body portions so as to be useable when the neck support member is engaged to a main pillow edge in use to extend over a face of the main pillow body to cover at least part of a second a face of the main pillow body adjacent the pillow edge and configured so as to be useable such that at least part of the elongate member extends underneath at least part of the user's head when the user's head and neck is placed on the pillow in use; and/or b) the parts of the neck support member that are configured so as to i) be disposed to cover a part of a first face of the main pillow body adjacent the edge of the main pillow body; and ii) extend over the edge of the main pillow body toward the second face when the neck support pillow is engaged to a main pillow edge, have a curved outer surface profile that is substantially convex (i.e. outwardly curved) so as to be useable to contact the user when the neck pillow body is engaging a main pillow body edge and the user's head and neck is placed on the pillow in use; and/or c) the outer surface of the second body portion is configured such that when the neck support member is in engagement with a main pillow body edge in use, the outer surface of the second body portion projects in a direction directly away from the main pillow body no more than about 10 cm from the main pillow body edge (i.e. toward the user); and/or d) the neck support member has an outer surface and an inner core, the core consisting essentially of one or more deformable materials.

DETAILED DESCRIPTION OF THE INVENTION

First Aspect

Figure 1A:
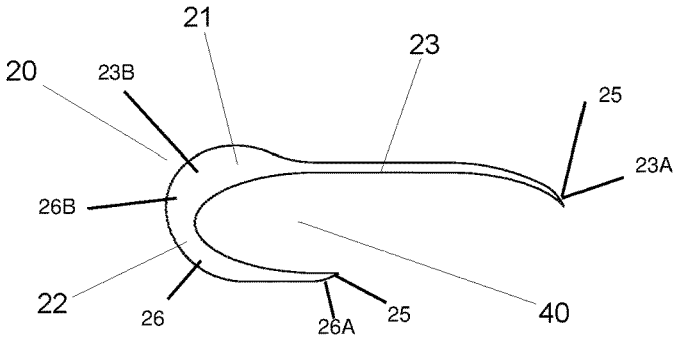
FIG. 1 depicts in A) a cross-sectional or side view of a neck support member of the invention wherein a first body portion/jaw member is provided with an elongate portion that is useable to extend farther over the pillow face than the second body portion; in B) a cross-sectional/side view illustration of the neck support member of FIG. 1A releasably engaged to a main pillow body to form a neck support pillow; and in C) a perspective illustration of the neck support pillow of FIG. 1B.

In a first aspect of the invention is provided a neck support pillow comprising a main pillow body and a neck support member releasably engaged to the main pillow body, the neck support member comprising a first body portion covering at least part of a first face of the main pillow body adjacent an edge of the main pillow body for supporting the neck in use and a second body portion extending from the first portion over the edge of the main pillow body towards a second face of the main pillow body, the neck support member providing a raised surface relative to the main pillow body surface for supporting the neck in use, the first body portion of the neck support member comprising an elongate body portion extending over the first main pillow body face away from the edge of the main pillow body to cover at least part of the first face of the main pillow body and configured such that, when the user's neck is supported by the neck support member, at least part of the elongate member extends underneath at least part of the user's head when the user's head and neck is placed on the pillow in use and/or the second body portion of the neck support member comprises an elongate body portion extending over the second main pillow body face away from the edge of the main pillow body to cover at least part of the second face of the main pillow body and configured such that, when the user's neck is supported by the neck support member, at least part of the elongate member extends underneath at least part of the user's head when the user's head and neck is placed on the pillow in use.

The elongate body portion extends over at least the first and/or second pillow faces and is configured such that at least part of the elongate member extends underneath at least part of the user's head when the user's head and neck is placed on the pillow in use, i.e. during normal use of the pillow. In other words, the dimensions of the elongate portion are such that it is useable so that, when a user's neck is positioned at the pillow edge supported by the neck support member and the user's head is placed on the main pillow face, the elongate portion(s) extends over the corresponding pillow face away from the pillow edge to an extent that it covers an area of the pillow underneath at least part of a user's head.

Reference to the elongate body portion "extending underneath" at least a portion of the user's head is intended to refer both to arrangements wherein the elongate body portion extends over the (top) face that is to come into contact with the head in use (and thus extend directly beneath the head), and also to arrangements wherein an elongate body portion extends over the (bottom) base pillow face, i.e. the pillow face opposite where the head is placed in use. In such instances, the elongate body portion will not be in a position to come into direct contact with the head, but will nonetheless still extend to cover an area of the main pillow underneath at least part of the user's the head (i.e. in the vertical plane).

Typically, the elongate body portion is long enough so as to extend in use at least as far as a user's ear when the user's head and neck are placed on the pillow during normal use, as described above. In embodiments, the elongate body portion is long enough so as to extend to at least the level of the eyes of the user, or more typically, the elongate member is long enough so as to extend far enough to pass underneath at least the entire head of the user. This ensures that a desirable level of support an comfort can be provided to the head. For instance, the elongate member may extend over substantially the entire width of the main pillow body face. Typically, the elongate member extends along the length of the main pillow at least far enough so as to cover an area corresponding to the entire width of a user's head. Further embodiments describing the dimensions of the first and/or second portions comprising the elongate body portion are described below under "elongate body portion".

By providing a first and/or second body portion of the neck support member with an elongate body portion extending over a face of the main pillow body, a number of surprising advantages are provided (in addition to the advantages described above under the title "Summary of invention"). By providing an elongate portion as part of the neck support member, the elongate portion can either extend over the surface on which the head of the user is to be placed in use, or it may pass underneath the main pillow body to extend over the pillow face that will in practice provide the base surface on which the pillow is placed for use by the user. In either arrangement, an increased contact surface area is provided between the neck support member and the main pillow body surface, thus increasing the level of lateral force required to slide the neck support member sideways or outwards relative to the main pillow body, which in turn significantly reduces the movement of the neck support member relative to the main pillow when the pillow is in use. Indeed, when the weight of the user's head is placed on the pillow, the additional pressure placed on the elongate portion by the head (directly on the elongate portion if an elongate portion extends along the face of the pillow on which the head is placed in use and/or indirectly if an elongate portion extends over the underface of the pillow in use) has been found by the inventor to provide a surprisingly effective reduction in movement of the neck support member in use.

Moreover, this arrangement has the advantage that the neck support member may not only be used to provide desirable neck support, but may suitably also allow for additional support and comfort for the head to supplement the neck support already provided by the main pillow body.

An additional advantage is that this arrangement also results in a product that is reported by users to appear and feel more similar to integrated neck support pillows, such as contoured orthopaedic pillows, thus combining advantages associated with integrated products with advantages associated with detachability of supplementary neck supports as mentioned above.

Second Aspect

In a further aspect is provided a neck support pillow comprising a main pillow body and a neck support member releasably engaged to the main pillow body, the neck support member having a first body portion covering at least part of a first face of the main pillow body adjacent an edge of the main pillow body and a second body portion extending from the first body portion over the edge of the main pillow body towards a second face of the main pillow body, the neck support member providing a raised surface relative to the main pillow body surface for supporting the neck in use, wherein the parts of the neck support member adjacent the edge of the main pillow body and extending over the edge of the main pillow body that are configured to contact a subject in use have a curved outer surface profile that is substantially convex (i.e. outwardly curved).

The term "outer surface profile" is intended to refer to the general profile of the outer surface of the neck support member that is disposed to contact a user when the neck support member is engaging a main pillow body in use. Contrastingly, the "inner surface profile" is intended to refer to the general surface profile of the surface of the neck support member that is disposed to contact the main pillow body surface when the neck support member is engaging a main pillow body in use.

The parts "configured to contact a subject in use" refers to the parts that are disposed so as to be useable to contact the user during use of the pillow (when the bottom face of the pillow is placed on a surface and the subject's head and neck are placed on the top face of the pillow).

The curvature mentioned above refers to the surface profile in the region of the neck support member corresponding to the parts of the first and/or second portions (suitably in a plane perpendicular to the pillow surface (or the surface on which the pillow is placed for use)) that are disposed so as to be presented to the user of the pillow in use, i.e. that are arranged to contact the neck, and optionally shoulder, of the user. It is not intended that the outer surface of the cross-sectional area of the first and second portions of the neck support member must be perfectly convex. It will be appreciated for instance that an outer surface may contain additional secondary surface features (whether by design or present as minor defects) and thus in such instances, the term "outer surface profile" is intended to refer to the primary outer surface profile. Indeed, the primary outer surface profile may include secondary surface profile features on a scale that is visible to the eye but that may not be substantially convex in themselves, e.g. they may be concave in surface shape, provided the overall primary profile is substantially convex. By way of analogy, the part of a conventional car tyre that contacts the road in use has a convex outer primary surface profile that nonetheless comprises secondary surface depressions/grooves forming the tyre tread which are not in themselves convex in cross-section, but which do not alter the convex outer primary surface profile.

Thus, in embodiments, the substantially convex outer primary surface profile includes secondary surface features, such as recesses (e.g. pits and/or grooves) or protrusions (e.g. nodules). Such features may be beneficial for providing improved air circulation, flexibility and/or comfort to the user. Suitably, in embodiments the outer surface of the neck support member may not include secondary surface features, such pits and/or grooves.

The neck support member of the invention may further comprise a tertiary surface profile curvature extending along the length of the pillow edge in a plane perpendicular to the primary surface curvature, e.g. in the same horizontal plane as the pillow edge when the pillow is placed on a surface in use. For instance, the thickness of the first and/or second portions of the neck support member may in embodiments vary along the length of the neck support pillow to create further curvature along the edge length. In embodiments wherein the central portion of the neck support member (i.e. the part of the neck support member that is closest to the central portion of the edge of the main pillow body) is thinner than the outer portions of the neck support pillow (i.e. the parts of the neck support member that are farthest from the central portion of the edge of the main pillow body when engaged on the main pillow body), a gradient of curvature across the length of the neck support pillow may be provided where the surface further presents a tertiary surface profile that may present a curvature at a plane lateral to the primary surface profile. In other words, when the neck support member encases a pillow, it may be thicker in the centre compared to its outer edges (i.e. it may bulge in the centre), or it may be thicker at the edges than the centre, meaning that an inner, saddle-like curve is formed. Thus, the neck support member may present a tertiary surface profile having an as inward curvature rising from the highest point in the region of the edges to the lowest point at the centre of the neck support member (in other words, presenting a concave saddle-like surface to the user's neck) or where the surface curves away from the user from a highest point in the centre (i.e. downwards when placed in a resting state on a surface ready for use, thus bulging at the centre, the term "resting state" referring to the state of the pillow when a user's neck and head is not placed on the pillow asserting a pressure on the pillow surface) from the highest point in the centre of the neck support member to a lowest point at the edges (in other words, forming a barrel-like surface for accepting the neck in use). Typically, the neck support member of the present aspect and embodiments does not have a tertiary surface profile in its resting state, i.e. wherein the thickness of the respective first and second portions of the neck support member is substantially uniform along the substantially the entire length of the edge, e.g. the entire length.

The outer curved surface may be of any suitable gradient of curvature provided the surface is able to at least partially conform to the recess of a user's neck. In embodiments, the gradient of curvature is such that the outer surface of the first and second portion substantially reflects (i.e. is substantially the same as) the outer surface profile at the edge of the main pillow body. In embodiments, the gradient of curvature of the outer convex face may be substantially similar (such as identical) to the inner concave surface curvature of the neck support member cavity/recess that accepts the main pillow body. It will be appreciated however that in use, the internal shape of the recess for a given neck support member may vary depending on the thickness of the main pillow body. If the neck support member is used with a main pillow that is relatively thick, the first and second neck support body portions (i.e. the first and second jaw members) may be forced apart (e.g. to adopt a "V-shape"), whereas for relatively thinner pillows, the first and second body portions may be relatively closer together (e.g. to adopt a "U-shape"). Typically, the curvature of the outer convex surface may be substantially dissimilar to the curvature of the main pillow at the region of the pillow edge pillow edge, and substantially dissimilar to the curvature of the inner surface (i.e. the recess).

In embodiments, the part of the second body portion that overlaps the main pillow body edge (i.e. the edge part) is provided with a curved outer surface profile (for contacting the user's neck and/or shoulder in use), and the part of the second body portion that extends over the face of the opposing pillow edge (i.e. the face part) may have a flat outer surface profile (i.e. so as to provide a stable base on which the pillow can rest).

The "curved outer surface profile" of the edge portion above refers to a convex curvature in the plane perpendicular to the pillow face, i.e. perpendicular to the surface on which the pillow is placed for use. Typically, even if the outer surface profile of the part of the second body portion that extends over the face of the opposing pillow edge is not flat or substantially flat when the pillow is placed on a surface in its resting position (i.e. prior to a user placing their head on the pillow), the surface will usually become flattened in use due to the weight of the users head and neck compressing the body filler material. Thus, in other words, the part of the second neck support body portion that extends underneath the main body pillow may have a substantially flat outer surface. Thus, this embodiment provides a stable base for placement of the pillow in use. Suitably therefore, the portion of the surface that is not in contact with the surface (e.g. mattress) and disposed to contact the user's neck in use is curved as described and the part of the neck support body portion (e.g. the second body potion) that is disposed to contact the base surface in use is flat. The flat surface may thus be formed as such and so is flat in its resting state, or is rather not formed as such but made flat in use by compression.

In embodiments wherein the neck support member has curved and flat portions as described, the point of transition from the curved portion to the flat portion of the second body portion may be by way of an angular point. Alternatively the point of transition may be smooth from the curved to flat portions (as described in FIG. 7). This will typically depend on the gradient of curvature of the second body portion of the neck support member at the point of transition. If the gradient of curvature is lower, i.e. if the surface is less curved a more angular transition is likely to be provided. Greater gradients of curvature may lead to smoother transition. Whilst a smoother transition may improve feel and comfort of the neck support pillow, a more angular transition may provide more stability against compression of the neck support member.

In embodiments, the neck support member is configured so as to allow a user when laying on their side, i.e. on their shoulder (e.g. during side-sleeping) to place the shoulder on the base surface to abut the neck support member (e.g. mattress) and simultaneously provide support for the neck and head. By providing a neck support member having a substantially convex outer surface profile at the region of the pillow edge disposed to contact the user, the outer surface of the neck support member is better able to reflect the surface contour of the main pillow body. This means that the neck support member is less bulky and so can fit more easily into a conventional pillow case in use, and will provide desirable comfort and support for the neck not only during back-sleeping, but also side-sleeping because the shoulder can adopt a more natural position during side-sleep on the side by simultaneously being allowed to contact the base sleeping surface and abut the outer surface of the neck support member. This feature is not provided for instance in prior art products that provide non-convex shoulder/upper back ramps, where the presence of the ramps means that the resulting product is bulky and may not suitably fit inside a conventional pillow case when in use, and wherein the presence of such ramps means that desirable support and comfort for the neck is not provided during side-sleeping as the shoulder cannot rest naturally on the sleeping surface close to the main pillow, and so the user is limited to back-sleeping. A pillow arrangement containing a ramp is also limited to one-sided use as the edge of the ramp would not be suitable for supporting a neck or head if the pillow were flipped so that the flat edge of the ramp were disposed to contact the user.

Suitably, the neck support member of the present aspect and embodiments thus does not include an upper back/shoulder ramp.

Further embodiments of the second aspect are described in more detail herein and may for instance be as defined above for the first aspect of the invention and its embodiments.

Third Aspect

In a further aspect is provided a neck support pillow comprising a main pillow body and a neck support member releasably engaged to the main pillow body, the neck support member having a first body portion covering at least part of a face of the main pillow body adjacent an edge of the main pillow body and a second body portion extending from the first body portion over the edge of the main pillow body towards a second (e.g. opposing) face of the main pillow body, the neck support member providing a raised surface relative to the main pillow body surface for supporting the neck in use, wherein the outer surface of the second body portion projects in a direction directly away from the main pillow body no more than about 10 cm from the main pillow body edge (i.e. toward the user).

Preferably, the reference to projection of the surface of the second body portion refers to projection in a horizontal plane (i.e. sideways) toward the user's shoulder of the portion of the neck support member overlapping the pillow edge. Suitably, reference to "projecting a distance away" from the main pillow body surface in this regard refers to the distance from the outermost edge of the main pillow to the outermost surface of the neck support member. Preferably, this corresponds to the thickness of the neck support member in the region of the pillow edge. It will be appreciated that increasing the thickness of the edge part will extend the outer surface of the edge part closer to the user (i.e. outwards along the same plane as the pillow) when the user's head is placed on the main pillow body. It is not desirable to extend the thickness of the second body portion in the edge region significantly as this would then prevent the user placing their shoulder close enough to the pillow when side-sleeping to place their head on the pillow and benefit from the neck support function.

In this aspect, the neck support member is thus configured so as to allow a user, when lying on their side, i.e. on their shoulder (e.g. during side-sleeping) to place the shoulder on the base surface to abut the neck support member (e.g. mattress) and simultaneously provide support for the neck and head. In limiting the level of protrusion of the outer surface of the second body portion toward the user in the region of the edge of the pillow (i.e. by limiting the thickness of the second body portion in the region of the pillow edge), a number of advantages are provided. For instance, the neck support member is less bulky and so can fit more easily into a conventional pillow case in use. The neck support member also provides a high degree of comfort and support for the neck not only during back-sleeping, but also side-sleeping because the shoulder can adopt a natural position during side-sleeping by allowing the shoulder to be placed close enough to the pillow to allow the head and neck to be adequately supported by the neck support pillow, whilst simultaneously contacting the base sleeping surface and abutting the outer surface of the neck support member in the vicinity of the main pillow edge. This advantage is not provided for instance in prior art products that provide shoulder/upper back ramps that protrude significantly from the main pillow body beyond the length of a user's neck, thus increasing bulk (such that the neck support member may not suitably fit inside a conventional pillow case when in use), and wherein the presence of such ramps means that desirable support and comfort for the neck is not provided during side-sleeping as the shoulder cannot rest naturally on the sleeping surface in a position close enough to the pillow to allow the head and neck to benefit from the support the neck support pillow is intended to provide.

Suitably, the outer surface of the second body portion in the edge region (i.e. the part of the neck support member that extends laterally toward the user's shoulder in use) in embodiments projects no more than about 9 cm away from the main pillow body edge, such as no more than 8 cm, 6 cm, 4 cm, 3 cm, 2 cm, 1 cm, 0.5 cm or 0.3 cm.

In suitable embodiments, the part of the second body portion extending from the first body portion towards the second pillow face projects away from the main pillow edge (i.e. the part of the neck support member that extends laterally toward the user's shoulder in use) by at least 3 mm, such as at least 5 mm, e.g. at least 8 mm, at least 1 cm, at least 1.5 cm, at least 2.0 cm, at least 2.5 cm, or at least 3.0 cm, 4 cm, or 6 cm. In embodiments, the outer surface of the second body portion projects away from the edge of the main pillow body by from 1 cm to 5 cm, e.g. from 2 cm to 4 cm, e.g. most typically around 3 cm.

Suitably, the body thickness of the part of the second body portion extending from the first face to the pillow second face may thus have a thickness of no more than 10 cm, such as no more than 8 cm, 6 cm, 4 cm, 3 cm, 2 cm, 1 cm, 8 mm, or 5 mm. In embodiments, the thickness is at least 3 mm, such as at least 5 mm, 1 cm, 2 cm, 4 cm, 6 cm or 8 cm. In typical embodiments, the thickness is from 0.5 mm to 10 cm, more typically from 1 cm to 5 cm, e.g. from 2 cm to 4 cm, e.g. most typically around 3 cm.

The second body portion may be substantially (e.g. entirely) the same thickness over its entirety or the thickness may vary throughout the body portion. In other words, the second body portion may be thicker in some parts than in other parts. For instance it may suitably be thicker in the region of the main pillow edge, or it may be thicker in a region remote from the pillow edge, e.g. in a region extending over the second face of the main pillow body (e.g. underneath the pillow). In other words, the "edge part" and "face part" of the second body portion may for instance have different thicknesses. It will be appreciated that increasing the thickness of the edge part will extend the outer surface of the edge part closer to the user (i.e. outwards along the same plane as the pillow) when the user's head is placed on the main pillow body. It is not desirable to extend the thickness of the second body portion in the edge region significantly as this would then prevent the user placing their shoulder close enough to the pillow when side-sleeping to place their head on the pillow and benefit from the neck support function.

It will be appreciated that the thickness of the second body portion will not only provide the advantages above in terms of bulk and placement of the shoulder during side-sleeping, but will also contribute to the support function of the neck support member as the body portion extending over the pillow edge can provide an additional layer of structure to the pillow edge, which in turn helps to reduce the amount of compression that takes place when the user rests their head and neck on the pillow. The compression of the outer portion of the edge by a neck of a user in use may also cause the outer surface of the second body portion to push further away from the pillow edge against the user's neck and shoulders in use, thus providing further support.

Further embodiments of the third aspect are described in more detail herein below and may for instance be as defined above for the first and/or second aspect of the invention and their embodiments.

Fourth Aspect

In a further aspect is provided a neck support pillow comprising a main pillow body and a neck support member releasably engaged to the main pillow body, the neck support member having a first body portion covering at least part of a face of the main pillow body adjacent an edge of the main pillow body and a second body portion extending from the first body portion over the edge of the main pillow body towards a second face of the main pillow body, the neck support member providing a raised surface relative to the main pillow body surface for supporting the neck in use, wherein the neck support member has an outer surface and an inner core, the core consisting essentially of one or more deformable materials (i.e. materials which are deformable by the weight of a user's head/neck during normal use of the pillow).

Suitably, by ensuring that the inner core consists essentially of deformable materials, the pillow provides adequate support but with increased comfort for the neck during long rest periods, such as during sleep. Moreover, this provides for greater ease of construction.

Where it is mentioned in relation to this aspect and its embodiments that the core is "consisting essentially of" or "consists essentially of" one or more materials that are deformable during normal use of the pillow, the core may in embodiments suitably be consisting "consist of" said materials.

The term "deformable material" includes materials which are deformable by the weight of a user's head/neck during normal use of the pillow. In this context, the term "deformable materials" is meant to include materials that can themselves be deformed in use (such as by compression), e.g. viscoelastic materials, and also particulates which, by virtue of their particulate nature, are moveable within the core to allow the surface of the neck support member to be deformed in use regardless of whether the particles themselves may be deformed (e.g. compressed). Deformable may in embodiments refer to compressable.

Preferably, the one or more deformable materials are selected from materials that are themselves deformable during normal use of the pillow, e.g. memory foam.

Materials that are deformable in themselves during normal use of the pillow may suitably be provided in particulate form, or may more preferably be provided as a single core piece, such as a core formed as a single piece (e.g. by carving or moulding) or formed by integration of multiple pieces, such as by adhesion of multiple layers of core filler material, e.g. lamination, to form a single piece having multiple integrated parts.

In embodiments, the body core consists essentially of more than one deformable material, e.g. no more than two or three. Preferably, the core consists essentially of only one deformable material, e.g. memory foam. It is intended that where the deformable material is a solid or liquid, the term "only one material" in this context is not meant to exclude the presence of gases, e.g. air, that may also be present within the filler, such as within air pockets or between particles in the case of particulate fillers.

Preferred materials are resilient materials, i.e. materials that can at least partially, and preferably substantially, return to their initial pre-use resting state following use when the pillow is not supporting a user's neck/head.

Suitable materials have a density that provides adequate support for the user's head and neck, and a firmness that provides a desirable surface feel.

The firmness of a given material is closely associated with the potential for surface pressure reduction. The firmness of a material, such as memory foam, may be quantified in terms of Indention Force Deflection (IFD) which is defined as the amount of force, in pounds, required to indent a fifty square inch, round indentor foot into a predefined material (e.g. memory foam) specimen a certain percentage of the specimen's total thickness (i.e. the force in pounds required to compress (indent) a sample of foam at a specified percentage of its thickness across a surface area of 50 square inches).

To conduct an IFD test, a circular flat indenter with a surface are of 323 square centimeters (50 sq. inches) is pressed against a foam sample usually 100 mm thick and with an area of 500 mm by 500 mm (ASTM standard D3574). The foam sample is first placed on a flat table perforated with holes to allow the passage of air. It is then "warmed up" by being compressed twice to 75% "strain", and then allowed to recover for six minutes. The force is measured 60 seconds after achieving 25% indentation with the indenter.

Lower scores correspond with less firmness; higher scores with greater firmness.

Thus, the higher the IFD measurement, the firmer the foam will feel. IFD is in some older disclosures referred to as Indentation Load Deflection ("ILD").

The IFD value varies with material (e.g. foam) thickness. A skilled person would be able to determine a desirable IFD for a given purpose as described herein. The core material (e.g. memory foam) may thus have an IFD of from around 1-45, such as 1-20 or 1-10. In embodiments, the IFD is from 4-45, 4-40, such as from 4-35, from 4-30, from 4-25, from 4-20, or from 4-15. The neck support member may have an IFD of from 4-20, such as 4-15 or 6-12 (a range of 6-12 is typical for conventional bed pillows).

The density of the main pillow body core material (e.g. memory foam) may be quantified as pounds per cubic feet ("Lbs/ft$^3$", also denoted as "pcf" in some published material).

The higher the foam density of the core material, the more support it will provide to the user's head a neck and the more durable it will be. In embodiments, the core material may thus have a density of from 0.6-12 Lbs/ft3, such as from 0.6-10, 0.6-8, 0.6-6, 0.6-5, 0.6-4, 0.6-3.5 or from 0.8-1.5 Lbs/ft3. The density of the core material may suitably be no lower than 0.8 and/or no greater than 6 Lbs/ft3. In embodiments, the core material may thus have a density of from 0.8-2.5 Lbs/ft3, 1.3-2.0, 1.5-3.5, 1.5-4.0, 1.5-5.0, 1.5-6.0, or 3.5-10.0 Lbs/ft3. In suitable embodiments, the density is from 1-10 Lb/ft3 or 2-5.5 Lb/ft3.

The one or more core materials may be selected independently from solids, liquids and gases. In embodiments, the one or more core materials are selected from the groups of solids and liquids.

The one or more core materials (i.e. fillers) may be selected independently from synthetic materials and natural materials. Exemplary synthetic pillow filler materials include gels (e.g. cooling gel), polyester (e.g. polyester pellets), polyolefin ("POE"), polyester/cotton blends, microbeads, polystyrene (e.g. polystyrene foam, either shredded or solid) and polyurethane (e.g. viscoelastic foam, i.e. memory foam). Exemplary natural fillers include water, air, down (and other feathers), cotton, wool, coir, animal hair (e.g. horse hair, cashmere, mohair, angora and alpaca), natural rubber (e.g. natural latex, India rubber or caoutchouc, which may be provided in shredded or non-shredded, i.e. solid form), extracts from trees (e.g. Kapok) and plants (e.g. bamboo) and seeds and herbs (e.g. buckwheat, millet, flaxseed, lavender, silk, and hemp).

The one or more core materials (i.e. fillers) may be selected independently from gels (e.g. cooling gel), polyester (e.g. polyester pellets), polyolefin ("POE"), polyester/cotton blends, microbeads, polystyrene (e.g. polystyrene foam, shredded and solid), polyurethane (e.g. viscoelastic foam, e.g. memory foam), water, air, down (and other feathers), cotton, wool, coir, animal hair (e.g. horse hair, cashmere, mohair, angora and alpaca), natural rubber (e.g. natural latex, India rubber or caoutchouc (which may be provided in shredded or non-shredded, i.e. solid form), trees extracts (e.g. Kapok) plants extracts (e.g. bamboo), seeds and herbs (e.g. buckwheat, millet, flaxseed, lavender, silk, and hemp).

The one or more body core materials (i.e. fillers) may be selected from the group consisting of fibres (e.g. polyester fibres), gels (e.g. cooling gel), buckwheat, foam, latex, pellets, microbeads, feathers and down. In embodiments, said fibres are hollow fibres. In further embodiments, the body may be inflatable (i.e. it may be entirely inflatable or contain inflatable pockets). Typically, the neck support member is not inflatable. In preferred embodiments, the one or more materials may be selected from the group consisting of polyolefin, polyester and polyurethane. Polyester may for instance be in the form of fibres. Polyurethane and/or polyolefin may be provided as a foam. Polyolefin may alternatively be provided as a gel. In embodiments, the body core material is selected from the groups consisting of fibres (preferably polyester fibres), foam, and latex. More preferably, the one or more materials may be selected from the group consisting of foam and latex, more preferably foam. The latex may be natural or synthetic, e.g. natural.

Suitably, the foam may have a density as described above. Preferably, in embodiments, the foam is selected from high density foam and viscoelastic foam, e.g. memory foam (e.g. shredded or non-shredded memory foam). Most preferably, the foam is memory foam (e.g. shredded or non-shredded memory foam). For instance, in most preferred embodiments, the body core may consist essentially of memory foam, such as shredded or non-shredded memory foam. The body core may thus consist essentially of shredded memory foam. Alternatively, the core may consist essentially of non-shredded memory foam. In more particular embodiments, the core material may consist of said memory foam. In the above embodiments, the term "memory foam" may typically refer to polyurethane memory foams.

As mentioned herein, "high density foam" may have a density of 3.5-10.0 pounds per cubic foot (pcf), such as 4 to 7 pounds per cubic foot, such as about 4 to 5 pounds per cubic foot. The foam of the invention may typically have a high degree of initial viscoelasticity and the ability to retain the viscoelasticity over time.

The neck support members of the present invention having first and second body portions may thus suitably comprise first and second body core portions consisting essentially of (such as consisting of) one or more body core materials. Suitably these cores may notionally be different parts of a single core, may be discrete parts not integrated within the body portion, or may be different parts integrated into a single form (e.g. by adhesion or moulding). Thus, each part may be made of the same material, or in the alternative, the different core parts may be different materials (such as where the materials are tailored to the specific position and function on the main pillow body.

The respective remaining features of the above aspect may be as defined for any of the aspects and embodiments herein, for instance with reference to the first to third aspects and their embodiments above.

General Description of Neck Support Pillow Features

In general, in the aspects and embodiments according to the present invention, a neck support pillow comprises a main pillow body and a neck support member releasably engaged to the main pillow body, the neck support member comprising a first body portion covering at least part of a first face of the main pillow body adjacent an edge of the main pillow body for supporting the neck in use and a second body portion extending from the first portion over the edge of the main pillow body towards a second face of the main pillow body, the neck support member providing a raised surface relative to the main pillow body surface for supporting the neck in use. In preferred embodiments, only a single neck support member is releasably connected to the main pillow body. In other words, when a neck support member of the present invention is used as described herein, e.g. to releasably engage the edge of a main pillow body, it is preferable to use only a single neck support member to releasably engage the main pillow body at any one time.

The neck support members of the present disclosure engage the main pillow by extending from a portion of the face of the pillow adjacent the pillow edge over the edge of the pillow towards the second, i.e. opposing, pillow face, i.e. partly wrapping around/encasing the edge of the pillow. This is distinct from prior art supplementary neck supports that merely abut against, or are placed on top of, the main pillow body for supporting the neck and which thus merely rest against a single surface of the pillow. The neck support members of the present invention thus provide increased frictional contact relative to such prior art products and thus are less prone to movement relative to the main pillow body when in use.

Suitably, embodiments of the neck support members of the present invention are configured so that the pressure of the head and neck creates a compressional force on the edge of the main pillow body in use. This thus reduces movement of the neck support member relative to the main pillow body even further.

In embodiments, wherein the neck support members of the present invention extend from a first main pillow body face adjacent the pillow edge around the main pillow body edge to cover at least part of the opposing face of the main pillow body, the neck support members may engage the main pillow body by way of interference fit. Preferably, the neck support member is resilient, which would thus assist in providing an interference fit. For instance the neck support may comprise, or be formed of, a resilient material, such as memory foam.

Although the neck support pillow of the invention is useable to engage the edge of the main pillow body without any additional means of retaining the neck support pillow in place, additional means may be provided to improve the engagement between the neck support member and the pillow, provided the resulting engagement is readily releasable by the user. The neck support pillow described in any of the aspects and embodiments herein may thus optionally be provided with additional means (e.g. mechanism) for releasably engaging the main pillow body, such as wherein the neck support member is provided with a slip-resistant material, e.g. a material that has a high coefficient of friction, that reduces movement further by providing contact with at least the main pillow body edge or at least a portion of the main pillow body face adjacent the pillow edge (i.e. the slip-resistant material is typically provided on at least a part of the inner surface of the first and/or second neck support body portions). The neck support member may alternatively or additionally be provided with temporary (e.g. re-usable) adhesive, or surface features adapted to increase the frictional interaction of the neck support pillow with the main pillow body. Thus, the neck support member may be less likely to slip or to move when it is in engaged with the main pillow body by a user to form a neck support pillow of the invention. The neck support member and/or pillow may thus be provided with mutually connective mechanisms such as a tether and anchor, press studs, zip and/or Velcro as a means of additional engagement with the main pillow.

Various embodiments of the invention including suitable embodiments of the features of the aspects and embodiments mentioned above are provided herein below.

Main Pillow Body

Typically, pillows have a first (i.e. upper) face for resting the head during sleep/rest, a substantially opposing second (i.e. lower) face that contacts the surface on which the pillow is placed, and at least one pillow edge portion joining the two faces (one continuous edge may be present in circular pillows, but there are usually four distinct pillow edges in the case of a conventional bed pillow having a substantially rectangular face). The main pillow body of the present invention may be according to any of such arrangements.

An advantage of the neck support members of the present disclosure is that any suitable pillow may be used as the main body portion in forming a neck support pillow of the invention. The main pillow body as referred to in aspects and embodiments of the present disclosure may thus be any suitable main pillow body for supporting the head in use, e.g. having an outer surface and a main pillow body core portion comprising a filler material. Typically, the main pillow body is not formed of multiple component parts, i.e. it is of a simple pillow construction. That is, in typical embodiments, the main pillow body portion (not including any pillow case, if present) is formed of a single component having an outer surface and a main pillow body core portion comprising a filler material and not, for instance, formed of multiple interlocking body portions that each have their own surface and filler parts and which combine to give a complex main pillow body formation.

The main pillow body according to any of the aspects and embodiments described herein may in embodiments have a maximum thickness of no more than around 25 cm at its thickest portion in its resting state (i.e. when the pillow is not supporting the user's head and/or neck in use), such as no more than 20 cm, for instance no more than 15 cm, e.g. no more than 10 cm, in embodiments no more than 8 cm, 7 cm, 6 cm, 5 cm, 4 cm, 3 cm or 2 cm. In other embodiments the main pillow body may be no more than 1 cm thick (such as may be the case in children's pillows). Suitably, the main pillow body may have a minimum thickness of at least 2 cm. Alternatively, the main pillow body may have a thickness of at least 3 cm, 4 cm, 5 cm, 6 cm, 7 cm, 8 cm, 10 cm, 15 cm or at least 20 cm. Typically the main pillow body has a thickness of from 1-20 cm, or 1-23 cm, such as from 1-15 cm or from 1-10 cm. In embodiments the main pillow body has a thickness of from 2-20 cm, 2-15 cm, 2-10 cm, or more preferably from 3-10 cm.

Whilst the main body pillow of the present invention may be a pillow having a neck support feature integrated with the main pillow body (such as a contoured neck support), typically the main pillow body according to any of the aspects and embodiments described herein is not a pillow having a neck support feature integrated with the main pillow body (such as a contoured neck support). For instance, in embodiments, the main pillow body is not a neck support pillow having a pre-configured neck support contour, such as an orthopaedic pillow. This is because the neck support provided by commercial integrated neck support pillows is usually already adapted to compensate for a lack of support in the neck region.

The main pillow body may or may not be of a uniform thickness throughout. In embodiments, the main pillow body according to any of the aspects and embodiments described herein has a body portion that is thicker at the centre when in a resting state (i.e. when the pillow is not supporting a user's head and neck in use) than one or more portions of the main pillow body adjacent the pillow edges, such as is the case in conventional standard bed pillows. In such embodiments, the upper surface of the pillow on which the head is placed in use may have a convex surface curvature from pillow edge to pillow edge in its resting state, i.e. when it is not being deformed in use. Suitably, the pillow may therefore have a predefined convex surface profile.

In typical embodiments, the main pillow body is a conventional pillow, e.g. a conventional bed pillow, which may be provided with or without a pillow case (such as a removable pillow case).

Exemplary bed pillow length and width dimensions that are typically available in the marketplace are presented below. The main pillow body of the neck support pillows of the present disclosure may thus suitably be substantially (e.g. exactly) according to any of such dimensions:

Small standard: 48 cm×73 cm; Standard: 51 cm×66 cm; Queen: 51×76 cm; King: 51 cm×91 cm; Junior: 35 cm×57 cm; and standard continental pillow: 65 cm×65 cm.

Other specific exemplary measurements in the marketplace are for instance around 40 cm×76 cm, 48 cm×74 cm, 48×76 cm and any of these are suitable for use in the present invention.

The main pillow body of the present disclosure may suitably therefore have a width of from around 30-70 cm, such as a width selected from the group consisting of from 30 40 cm, from 45-55 cm and from 60-70 cm. The main pillow body of the present disclosure may suitably have a width of at least about 30 cm, 35 cm, 40 cm, 50 cm, 55 cm, 60 cm, 65 cm, or 70 cm. The main pillow body of the present disclosure may, for instance, have a width of no more than about 40 cm, 50 cm, 55 cm, 60 cm, 65 cm, or at least 70 cm. In typical embodiments, the pillow width may be around 35 cm, 47 cm, 51 cm, or 65 cm, and is preferably around 47 cm.

The main pillow body of the present disclosure may suitably therefore have a length of from around 50-95 cm, such as selected from the group consisting of from 55 65 cm, from 60-70 cm, from 70-80 cm, or from 85-95 cm. The main pillow body of the present disclosure may suitably have a length of at least about 50 cm, 60 cm, 65 cm, 70 cm, 75 cm, 80 cm, 85 cm, 90 cm, or at least 95 cm. The main pillow body of the present disclosure may, for instance, have a length of no more than about 50 cm, 55 cm, 60 cm, 65 cm, 70 cm, 75 cm, 80 cm, 85 cm, 90 cm or at least 95 cm. In typical embodiments, the pillow length may be around 57 cm, 65 cm, 66 cm, 76 cm or 91 cm, preferably around 70 cm.

Main Pillow Materials

The main pillow body of any of the aspects and embodiments described herein has an outer surface and a main pillow body core comprising a suitable pillow material (i.e. filler material/stuffer/padding) for supporting a user's head in use. The outer surface of the main pillow may be a pillow case.

Suitably, the pillow material is selected from one or more materials that provide a desirable level of comfort to the head of the user. Where it is mentioned that the main pillow body core "comprises" or is "comprising" a material, it is intended that this includes embodiments with a main pillow body having a core that "consists essentially of" (or is "consisting essentially of") one or more of the materials, or suitably "consists of" (or is "consisting of") one or more of the materials.

Suitable core materials are typically deformable by a user's head during normal use of the pillow. Preferred materials are resilient materials, i.e. materials that can at least partially, and preferably substantially, return to their initial resting state following use when the pillow is not supporting a user's head (e.g. memory foam).

The term "deformable material" herein has the same meaning as described above for the fourth aspect. Preferably, the one or more deformable materials are selected from materials that are themselves deformable during normal use of the pillow.

The filler material may suitably be selected from the filler materials as described above for the fourth aspect. For instance the filler material may be provided in particulate form, as multiple pieces, or may be provided as a single core piece. The core may thus be formed as a single piece (e.g. by carving or moulding) or formed by integration of multiple pieces, such as by adhesion of multiple layers of core filler material, e.g. lamination, to form a single piece having multiple integrated parts. Suitably, the main pillow core portion may contain particulate material, such as in conventional bed pillows. In embodiments, the core material may be a single piece, such as a piece formed of multiple separate core components integrated to form a single piece (e.g. by lamination). For instance, the main pillow body core may be provided as separate core components integrated into a single piece. Preferably, the main pillow body core is formed from a single core piece. For instance, the main pillow body core may be moulded or sculpted as a single piece (e.g. from a larger piece). Suitably, the main pillow body core may be provided with a suitable outer layer or shell, such as a fitted pillow case, whether or not the main pillow body core is made of single or multiple pieces.

The pillow core materials may be selected from solids, liquids and gases. In embodiments, the main pillow body core comprises more than one material selected from solids and liquids. Preferably, the main pillow body core comprises only one material, e.g. a solid, such as memory foam. It is intended that where the material is a solid or liquid, the term "only one material" in this context is not meant to exclude the presence of gases, e.g. air, that may also be present within the filler material, such as within air pockets or between particles in the case of particulate fillers.

Suitable pillow materials have a density that provides adequate support for the user's head and neck and a firmness that provides a desirable surface feel. The effect of firmness on feel is described above and can be quantified in terms of Indention Force Deflection (IFD), which is defined above.

For example, the main pillow body of the invention may suitably be provided with a core material (e.g. memory foam) having an IFD of from around 4-45. In embodiments, the IFD is from 4-40, such as from 4-35, from 4-30, from 4-25, from 4-20, or from 4-15. Preferably, the main pillow body core material has an IFD of from 4-20, more preferably 4-15 and most preferably 6-12 (a range of 6-12 is typical for conventional bed pillows).

In embodiments, the core material may thus have a density of from 0.6-12 Lbs/ft3, such as from 0.6-10, 0.6-8, 0.6-6, 0.6-5, 0.6-4, 0.6-3.5 or from 0.8-1.5 Lbs/ft3. The density of the core material may suitably be no lower than 0.8 and/or no greater than 6 Lbs/ft3. In embodiments, the core material may thus have a density of from 0.8-2.5 Lbs/ft3, 1.3-2.0, 1.5-3.5, 1.5-4.0, 1.5-5.0, 1.5-6.0, or 3.5-10.0 Lbs/ft3. In suitable embodiments, the density is from 2-5.5 Lb/ft3.

The one or more main pillow body core materials (i.e. fillers) may be selected from synthetic materials and natural materials. Exemplary synthetic pillow filler materials include gels (e.g. cooling gel), polyester (e.g. polyester pellets), polyolefin ("POE"), polyester/cotton blends, microbeads, polystyrene foam (shredded and solid) and polyurethane (e.g. viscoelastic foam, e.g. memory foam). Exemplary natural fillers include water, air, down (and other feathers), cotton, wool, coir, animal hair (e.g. horse hair, cashmere, mohair, angora and alpaca), natural rubber (e.g. natural latex, India rubber or caoutchouc, which may be provided in shredded or non-shredded, i.e. solid form), tree extracts (e.g. Kapok), plant extracts (e.g. bamboo), seeds and herbs (e.g. buckwheat, millet, flaxseed, lavender, silk, and hemp).

The one or more main pillow body core materials may be selected independently from gels (e.g. cooling gel), polyester (e.g. polyester pellets), polyolefin ("POE"), polyester/cotton blends, microbeads, polystyrene (e.g. polystyrene foam, shredded and solid), polyurethane (e.g. viscoelastic foam, e.g. memory foam), water, air, down (and other feathers), cotton, wool, coir, animal hair (e.g. horse hair, cashmere, mohair, angora and alpaca), natural rubber (e.g. natural latex, India rubber or caoutchouc (which may be provided in shredded or non-shredded, i.e. solid form), trees extracts (e.g. Kapok) plants extracts (e.g. bamboo), seeds and herbs (e.g. buckwheat, millet, flaxseed, lavender, silk, and hemp).

The one or more main pillow body core materials (i.e. fillers) may be selected from the group consisting of fibres (e.g. polyester fibres), gel (e.g. cooling gel), buckwheat, foam, latex, pellets, microbeads, feathers and down. In embodiments, said fibres are hollow fibres. In further embodiments, the main pillow body may be inflatable (i.e. it may be entirely inflatable or contain inflatable pockets). In preferred embodiments, the one or more materials may be selected from the group consisting of polyester fibres, foam, and latex. More preferably, the one or more materials may be selected from the group consisting of foam and latex, more preferably foam. The latex may be natural or synthetic, e.g. natural.

Suitably, the foam may have a density as described above. Preferably, in embodiments, the foam is selected from high density foam and viscoelastic foam, e.g. memory foam (e.g. shredded or non-shredded memory foam). In embodiments, the foam may be latex foam. Most preferably, the foam is memory foam (e.g. shredded or non-shredded memory foam). For instance, in embodiments, the main pillow body core may comprise or, more particularly, consist essentially of memory foam, such as shredded or non-shredded memory foam. The core may thus consist essentially of shredded memory foam. Alternatively, the core may consist essentially of non-shredded memory foam. In more particular embodiments, the core material may consist of said memory foam. In the above embodiments, the term "memory foam" may typically refer to polyurethane memory foams.

As mentioned herein, "high density foam" may have a density of 3.5-10.0 pounds per cubic foot, such as 4 to 7 pounds per cubic foot, such as about 4 to 5 pounds per cubic foot. The foam of the invention may typically have a high degree of initial viscoelasticity and the ability to retain the viscoelasticity over time.

Neck Support Member

First Body Portion

Neck support members of the present invention as described herein suitably have a first body portion (for supporting the neck) covering at least part of a face (i.e. a first face, such as the upper, head-receiving face of the pillow in use) of a main pillow body adjacent an edge of the main pillow body for supporting the neck in use.

The first body portion provides a raised surface (i.e. an upper, neck contacting surface when the pillow is placed on a base surface with the first body portion is presented to the user) relative to the main pillow surface at the portion of the neck support pillow that supports the neck in use. By "raised surface", it is meant that the surface of the neck support member is distanced from the main pillow body surface by the neck support member body so as to provide a contact surface for the neck (or head and/or shoulder as the case may be) that is displaced in a vertical plane relative to the surface on which the pillow is placed. However, the term "raised surface" does not necessarily mean that the total height of the main pillow body is increased, only that the respective parts of the surface of the main pillow body covered by the first body portion have a raised surface relative to when no neck support member is provided.

By providing a raised upper surface, the first body portion projects toward the recess surface of the neck in use, thus providing suitable neck support to the user. For a given filler material, the greater the volume of the recess of the user's neck that is filled by raised first body portion in use (when the user's neck is placed in a neutral position relative to the spine), the better the support to the neck area because this will help to reduce the space in which the neck can bend in use and acts as platform for the user to rest the neck against. A user may prefer more or less support and the level of support that is provided to the neck by the first body portion of the neck support member can be tailored by adapting the level of thickness as well as the material type and density used as described further herein below. Suitably, the first body portion is configured such that when combined with a pillow to form a neck support pillow of the present invention, the thickness of the body portion configured so as to contact with the user's neck is operable in use so as to deflect the user's neck more towards a neutral position relative to the spine (i.e. relative to a pillow wherein the neck support member is not provided).

The body thickness of the first body portion may be substantially (e.g. entirely) the same over its entirety or it may vary throughout the body portion. In other words, the first body portion may be thicker in some parts than in other parts. For instance, in a preferred embodiment, the first body portion is thicker in the region of the pillow edge. The first body portion may have a body thickness that is different to the second body portion. In embodiments, the first body portion may have a body thickness that is substantially the same, such as exactly the same body thickness as the second body portion. In a preferred embodiment, the thickness of the entire neck support body portion is substantially the same, e.g. entirely the same throughout. This has the advantage that the neck support member may be formed of a single piece of material having a single thickness dimension, which provides greater simplicity of manufacture.

In embodiments, the first body portion has a minimum body thickness (i.e. the distance from the outer surface configured to face the user to the inner surface configured to face the main pillow body in use) of at least 3 mm, such as at least 5 mm, e.g. at least 8 mm, at least 10 mm, at least 15 mm, at least 20 mm, at least 25 mm or at least 30 mm. Suitably, in embodiments, the maximum thickness of the first body portion is no more than 15 cm, typically no more than 10 cm, such as no more than 8 cm, 6 cm, 4 cm, 3 cm, 2 cm, 1 cm, 8 mm, or 5 mm. Preferably, the thickness is from 1 cm to 5 cm, e.g. from 2 cm to 4 cm, e.g. most typically around 3 cm. As such, in use, the first body portion, when engaged on the neck support pillow of the present invention and in a resting state, i.e. prior to the user placing their head on the pillow, provides a raised surface relative to the face of the main pillow body adjacent the pillow edge of at least 3 mm, such as at least 5 mm, e.g. at least 8 mm, at least 10 mm, at least 15 mm, at least 20 mm, at least 25 mm or at least 30 mm. Preferably, the first body portion thus raises the surface disposed to contact the user's neck in use relative to the face of the main pillow body adjacent the pillow edge by from 1 cm to 5 cm, e.g. from 2 cm to 4 cm, e.g. most typically around 3 cm.

Suitably, the first body portion covers at least enough of the first face of the main pillow body adjacent the pillow edge to support the recess of the user's neck when the base of the user's neck is placed flush against the pillow edge. The first body portion may be configured such that when engaged to the pillow in use, the portion terminates in an area proximate to the main pillow edge (e.g. more proximate to the edge over which the second body portion extends than the opposing edge of the pillow). Alternatively, the first body portion may extend to cover a large part of the width of the pillow face, e.g. the first body portion may include an elongate body portion extending over a first pillow face away from the pillow edge when the neck support member is engaged with the pillow in use.

The first body portion of the aspects and embodiments herein may preferably comprise an elongate body portion extending over the first main pillow body face away from the edge of the main pillow body to cover at least part of the first face of the main pillow body and configured so as to be useable such that, when the user's neck is supported by the neck support member, at least part of the elongate member extends underneath at least part of the user's head when the user's head and neck is placed on the pillow in use. In this regard, the elongate portion of the first body portion may suitably be as described above for the first aspect and embodiments and as further described in more detail below under the title "Elongate body portion".

For instance, the first body portion may extend over the width of the main pillow face away from the pillow edge up to around 70 cm, 65 cm or 60 cm, such as up to around 55 cm, 50 cm, 45 cm, 40 cm, 35 cm, 30 cm, or 25 cm, such as up to 20 cm, 18 cm, 16 cm, for instance up to 15 cm, for instance up to 10 cm, or up to 5 cm. Typically, the first body portion may extend over the width of the main pillow face away from the pillow edge no more than 66 cm. In preferred embodiments, the first body portion may extend over the width of the main pillow face to around 47 cm.

Typically, where an elongate portion is provided, the elongate portion extends over the main pillow body surface away from the pillow edge such that the distance from the pillow edge (i.e. the edge of the main pillow body) to the portion of the elongate member farthest from the pillow edge is at least 10 cm. In this context, the pillow edge refers to the pillow edge over which the neck support member (i.e. the second body portion of the neck support member) extends from the first body portion. The distance may for instance be at least 12 cm, 14 cm, 16 cm, 18 cm, 20 cm, 25 cm, 30 cm, 35 cm, 40 cm, 45 cm, 50 cm, 55 cm, or at least 60 cm. The distance may for instance be around 35 cm, 47 cm, 51 cm or 65 cm, which are typical widths for pillows in the marketplace. In embodiments, the distance may be at least 68 cm, or at least 70 cm. For instance, the distance may in embodiments exceed the width of the pillow face. Preferably the distance is less than the width of the pillow. In embodiments, the distance may for instance be no more than 70 cm, such as no more than 68 cm, 66 cm, 65 cm, 55 cm, 50 cm, 40 cm, 30 cm, 20 cm, 18 cm or 16 cm.

Second Body Portion

Neck support members of the present disclosure have a second body portion extending from the first body portion (the first portion covering at least a part of a first face of the main pillow body adjacent an edge of the main pillow body) over an edge of the main pillow body towards a second face of the main pillow body.

By "extending over" an edge of the main pillow body toward a second face of the main pillow body, it is meant that the neck support member is configured to extend from the first body portion to wrap over the edge of the pillow body, i.e. the second portion does not merely protrude outwards past the outer edge of the pillow the pillow edge toward the user, but extends at least part way around the edge toward the opposing face of the main pillow body. The neck support may thus preferably substantially follow the edge surface contour of the main pillow body. This has the advantage of providing increased contact with the outer surface of the main pillow edge, improving the engagement of the neck support member to the main pillow body and reducing movement of the neck support member in use.

Figure 9A:
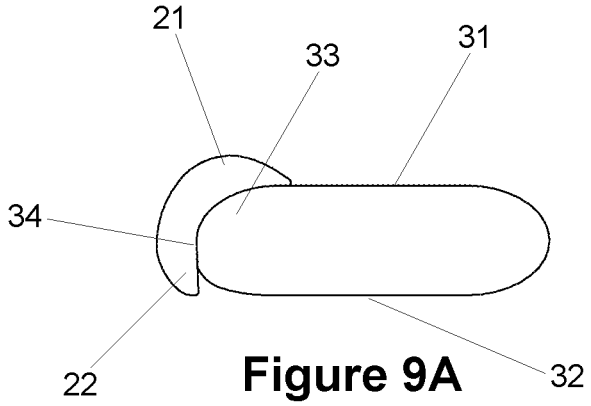
FIG. 9 depicts in A) a cross section/side view of a neck support pillow of the invention having an "r"-shaped inner surface profile, wherein the second body portion of the neck support member extends from the first body portion/jaw member over the pillow edge towards the second pillow face, but not to an extent so as to extend over the second pillow face and under the pillow; and in B) a cross section/side view of a neck support pillow of the invention wherein the second body portion/jaw member of the neck support member extends from the first body portion over the pillow edge towards the second pillow face, but not to an extent so as to extend over the second pillow face and under the pillow, the second body portion having a substantially flat base.
Figure 9B:
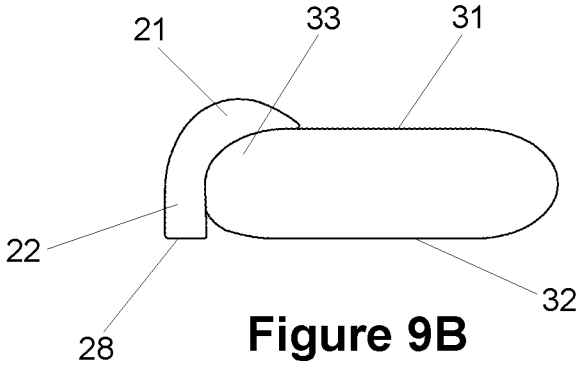

Put another way, the neck support member of the present invention wraps over an edge of the pillow to substantially encase the pillow edge. Thus, in embodiments of the aspects and embodiments of the present disclosure, the neck support member may thus substantially encase at least part of the length of an edge of the main pillow body suitable for supporting the user's neck. By substantially encase, it is meant that the second body portion in combination with the first body portion may extend up to the edge of the opposing surface of the pillow, but need not necessarily fully envelope the main pillow body edge. Thus, the neck support member may be formed such that the surface profile of the neck support member in contact with the main pillow body in use is generally "r" shaped, as depicted in FIGS. 9A and 9B.

Preferably, the second body portion extends from the first body portion so as to cover at least part of the second opposing face of the pillow. Suitably, the second portion may thus extend from the first body portion (the first body portion covering at least a part of the first face of the main pillow body adjacent the pillow edge) at a first main body pillow face (i.e. a first face, such as the upper, head-receiving face of the pillow in use) over the main pillow edge to cover at least part of the opposing pillow face (i.e. the second face, such as the lower, surface-contacting face) of the main pillow body adjacent to the pillow edge. Thus, in other words, the neck support member may entirely encase (or envelope) at least part of the length of an edge of the main pillow body. In such embodiments, if in use the first face of the main pillow body is positioned to contact the user's neck and head, and the second opposing face is configured to contact the base surface on which the pillow is placed (e.g. mattress), the second body portion may thus extend over the second pillow face to an extent that is disposed to be trapped between the bottom face of the pillow and the base surface. Thus, in extending over an edge of the main pillow body to cover at least part of a second face of the main pillow body, the second body portion is able to better engage the edge of the main pillow body that lies beneath the user's neck when the user's neck is supported by the neck support member and the user's head is placed on the pillow. A neck support member configured as such thus has an outer surface portion that contacts the user in use, and an inner surface portion, i.e. the cavity surface portion, that receives and releasably engages the main pillow body edge. In such embodiments, the inner surface profile of the neck support member, i.e. the surface disposed to contact the surface of the main pillow in use, may thus be of a substantially concave cross section, such as an "r", "U" or "V"-shaped cross section, in embodiments "U" or "V" and optionally "U" shaped. In embodiments, the inner surface profile of the neck support member, i.e. the surface disposed to contact the surface of the main pillow in use is different to the outer surface profile. This is because the purpose of the inner surface is to engage the pillow and the purpose of the outer surface is to contact the user's neck/head, meaning each may thus have different geometric profiles.

Because the neck support member extends over (i.e. at least partially wraps around, or at least partially encases) a main body pillow edge, the main pillow body is at least partially enclosed/contained by the neck support pillow providing a relatively high degree of frictional interaction between the main pillow body and the neck support pillow, meaning that movement of the neck support member relative to the main pillow body in use is significantly reduced, avoiding the need for additional means for connecting the neck support to the pillow (such as by providing tailored pillow cases or a permanent physical connection to attach the pillow and neck support). Furthermore, because the neck support member at least partially encases a portion of the pillow edge rather than merely abutting against, being placed on top of, or simply overhanging the pillow body, more structural support is provided to the neck support region at the pillow edge region as the neck support member is better able to resist the compressional forces acting on the pillow imparted by the head and neck. Moreover, the resulting neck support pillow formed by combining the main pillow body and neck support member has been observed to provide an appearance and feel that is less like a product comprising separate parts (such as when separate neck rolls or the like are provided abutting the main pillow), and more like a fully integrated product, improving user comfort.

Where the second body portion of the neck support pillow extends from a first face of the main pillow body around the edge of the main pillow body to cover at least a part of the opposing face (i.e. second face) of the main pillow body, the neck support member will entirely encase at least part of the edge of the main pillow body as described above that is covered by the neck support member (i.e. if the neck support member is not long enough to cover the entire length of the edge of the pillow, then a part of the pillow edge will not be encased by the neck support member). By entirely encasing at least the part of the main pillow body edge supporting the user's neck, a number of even more advantageous results are provided. For instance, this arrangement provides a larger contact surface area between the main pillow body and the neck support member, thus creating an improved frictional interaction between the neck support member and the main pillow body, reducing movement (particularly sliding movement) in use. By covering at least part of each pillow face at the pillow edge, additional structural support is also provided at the pillow edge for supporting the neck. This is in part due to the additional thickness provided at the pillow edge by the neck support portion passing underneath the pillow edge, but also because an increased compressional resistance is provided by the neck support member as a whole. This in turn means that in such embodiments, the thickness of the first and second body portions of the neck support member may be surprisingly low whilst still providing a suitable amount of neck support.

In preferred embodiments of the present disclosure where the second body portion of the neck support pillow is configured to extend from a first face of the main pillow body around the edge of the main pillow body to cover at least a part of the opposing face of the main pillow body, the first face may suitably be disposed in use to be the head-contacting face of the pillow, and the opposing, i.e. second face may suitably be disposed in use to be the surface-contacting (e.g. mattress-contacting) face of the pillow when the pillow is positioned for use by the user. Alternatively, the first face may be the surface-contacting (e.g. mattress-contacting) face of the pillow in use, and the opposing, i.e. second face may be the head-contacting face of the pillow. Thus, in embodiments, when a neck support pillow of the invention is presented on a surface ready for use, the first neck support body portion is disposed so as to cover a part of the first face adjacent an edge of the pillow for contacting the neck in use, and the second body portion extends underneath the main pillow body when the pillow is placed on a surface ready for use.

Suitably, where the second portion is referred to as extending over the edge of the main pillow body from the first body portion, it is meant that the second portion extends over the edge closest in proximity to the part of the main pillow body face covered by the first body portion.

When the second body portion extends over the edge of the pillow to the opposing face of the pillow (i.e. under the pillow), the part of the second body portion that overlaps the main pillow body edge (i.e. the edge part), and the part of the second body portion that extends over the face of the opposing pillow edge (i.e. the face part) may in embodiments have relatively different size dimensions (e.g. thickness, width, etc.). Similarly, when the second body portion extends over the edge of the pillow to the opposing face of the pillow (i.e. under the pillow), the part of the second body portion that overlaps the main pillow body edge (i.e. the edge part), and the part of the second body portion that extends over the face of the opposing pillow edge (i.e. the face part) may in embodiments have different outer surface profiles.

In embodiments, the part of the second body portion that extends over the main pillow body edge (i.e. the edge part) and which is configured so as to contact the user is provided with a curved outer surface profile (for contacting the user's neck and/or shoulder in use), and the part of the second body portion that extends over the face of the second, e.g. opposing, pillow edge (i.e. the face part) and in contact with the base surface may have a flat outer surface profile (i.e. so as to provide a stable base on which the pillow can rest). Suitably, reference to the curved outer surface profile of the edge portion above refers to a convex curvature in the plane perpendicular to the pillow face, i.e. perpendicular to the surface on which the pillow is placed for use. Typically, even if the outer surface profile of the part of the second body portion that extends over the face of the opposing pillow edge is not flat or substantially flat before the pillow is placed on a surface, or when the pillow is placed on a surface in its resting position (i.e. prior to a user placing their head on the pillow), the surface will become flattened in use due to the weight of the user's head and neck compressing the body filler material. Thus, in other words, the part of the second neck support body portion that extends underneath the main body pillow may have a substantially flat outer surface, wherein the flat surface may be formed as such prior to use, or configured such that it becomes flat in use due to compressional forces. Thus, this embodiment provides a stable base for placement of the pillow in use. Preferably, the portion of the surface that is not in contact with the surface (e.g. mattress) and disposed to contact the user's neck in use is curved.

The body thickness of the second body portion may be as described generally above according to any embodiment of the first body portion. The second body portion (including the edge part and the face part as described above) may have a body thickness that is different to the first body portion. In embodiments, the second body portion (including the edge part and the face part as described above) may have a body thickness that is substantially the same, such as exactly the same body thickness as the first body portion. In an embodiment, the thickness of the entire neck support body portion is substantially the same, e.g. entirely the same throughout.

In suitable embodiments, the second body portion has a minimum body thickness (i.e. from the outer surface configured to face the user (or the supporting surface in the case of the part of the second body portion that extends over at least a part of the second opposing pillow body face in embodiments that contain this feature) to the inner surface configured to face the main pillow body in use) of at least 3 mm, such as at least 5 mm, e.g. at least 8 mm, at least 10 mm, at least 15 mm, at least 20 mm, at least 25 mm or at least 30 mm. Suitably, the maximum thickness of the second body portion is no more than 15 cm or no more than 10 cm, such as no more than 8 cm, 6 cm, 4 cm, 3 cm, 2 cm, 1 cm, 8 mm, or 5 mm. Typically, the thickness is from 1 cm to 5 cm, e.g. from 2 cm to 4 cm, e.g. most typically around 3 cm.

The body thickness of the second body portion may be substantially (e.g. entirely) the same over its entirety or it may vary throughout the body portion. In other words, the second body portion may be thicker in some parts than in other parts. For instance it may suitably be thicker in the region of overlap with the main pillow edge, or it may be thicker in a region remote from the pillow edge, e.g. in a region extending over the second face of the main pillow body. It has already been described above that the "edge part" and "face part" in suitable embodiments may for instance have a different thickness. It will be appreciated that increasing the thickness of the edge part will extend the outer surface of the edge part closer to the user (i.e. outwards along the same plane as the pillow) when the user's head is placed on the main pillow body. It is not desirable to extend the thickness of the second body portion in the edge region significantly as this would then prevent the user placing their shoulder close enough to the pillow when side-sleeping to place their heard on the pillow and benefit from the neck support function. Suitably therefore the thickness in the edge region (i.e. the part of the second body portion that extends laterally toward the user's shoulder in use is no more than 15 cm, or no more than 10 cm, such as no more than 8 cm, 6 cm, 4 cm, 3 cm, 2 cm, 1 cm, 8 mm, or 5 mm. In embodiments, the thickness is at least 3 mm, such as at least 5 mm, 1 cm, 2 cm or 4 cm. In typical embodiments, the thickness is from 0.5 mm to 10 cm, more typically 1 cm to 5 cm, e.g. from 2 cm to 4 cm, e.g. most typically around 3 cm.

The second body portion may be configured such that when engaged to the pillow in use, the portion terminates in an area proximate to the main pillow edge (e.g. more proximate to the edge over which the second body portion extends than the opposing edge of the pillow). Alternatively, the second body portion may extend to cover a large part of the width of the pillow face, e.g. the second body portion may include an elongate body portion extending over a second pillow face away from the pillow edge when the neck support member is engaged with the pillow in use.

The second body portion of the aspects and embodiments herein may preferably comprise an elongate body portion extending over the second main pillow body face away from the edge of the main pillow body to cover at least part of the second face of the main pillow body and configured so as to be useable such that, when the user's neck is supported by the neck support member, at least part of the elongate member extends underneath at least part of the user's head when the user's head and neck is placed on the pillow. In this regard, the elongate portion of the second body portion may suitably be as described above for the first aspect and embodiments and as further described in more detail below under the title "Elongate body portion".

The second body portion may extend over the width of the main pillow face away from the pillow edge (i.e. toward the opposing pillow edge) up to around 70 cm, 65 cm or 60 cm, such as up to around 55 cm, 50 cm, 45 cm, 40 cm, 35 cm, 30 cm, or 25 cm, such as up to 20 cm, 18 cm, 16 cm, for instance up to 15 cm, 10 cm, or up to 5 cm. Typically, the first body portion may extend over the width of the main pillow face away from the pillow edge no more than 66 cm.

Typically, where an elongate portion is provided, the elongate portion extends over the main pillow body surface away from the pillow edge such that the distance from the pillow edge (i.e. the edge of the main pillow body) to the portion of the elongate member farthest from the pillow edge is at least 10 cm. In this context, the pillow edge refers to the pillow edge over which the neck support member, i.e. the second body portion of the neck support member extends over from the first body portion. The distance may for instance be at least 12 cm, 14 cm, 16 cm, 18 cm, 20 cm, 25 cm, 30 cm, 35 cm, 40 cm, 45 cm, 50 cm, 55 cm, or at least 60 cm. The distance may for instance be around 35 cm, 47 cm, 51 cm, or 65 cm, which are the typical widths for pillows in the marketplace. In embodiments, the distance may be at least 68 cm, or at least 70 cm. For instance, the distance may in embodiments exceed the width of the pillow face. Preferably the distance is less than the width of the pillow and in most preferred embodiments the distance is around 47 cm. In embodiments, the distance may be no more than 70 cm, such as no more than 68 cm, 66 cm, 65 cm, 60 cm, 55 cm, 50 cm, 45 cm, 40 cm, 35 cm, 30 cm, 25 cm, 22 cm, 20 cm, 18 cm or 16 cm.

It will be appreciated that the thickness of the second body portion will contribute to the support function of the neck support member as the body portion extending over the pillow edge can provide an additional layer of structure to the pillow edge, which in turn helps to reduce the amount of compression that takes place when the user rests their head and neck on the pillow. The compression of the outer portion of the edge by a neck of a user in use may also cause the outer surface of the second body portion to push further away from the pillow edge against the user's neck and shoulders in use, thus providing further support.

Elongate Body Portion

Neck support members of the present disclosure may suitably comprise an elongate body portion as part of the first and/or second neck support member body portions as described above for neck support pillows according to the first aspect of the invention. In embodiments, the neck support member of the present disclosure may be provided such that the first and second neck support member body portions comprise elongate body portions. Typically, at least one of the first and second body portions comprises an elongate body portion. In embodiments, only one of the first and second body portions comprises an elongate body portion.

Thus, in neck pillows of the present invention, the neck support member may comprise a first body portion comprising an elongate body portion extending over the first main pillow body face away from the edge of the main pillow body to cover at least part of the first face of the main pillow body and configured so as to be useable such that, when the user's neck is supported by the neck support member, at least part of the elongate member extends underneath at least part of the user's head when the user's head and neck is placed on the pillow and/or the second body portion of the neck support member comprises an elongate body portion extending over the second main pillow body face away from the edge of the main pillow body to cover at least part of the second face of the main pillow body and configured so as to be useable such that, when the user's neck is supported by the neck support member, at least part of the elongate member extends underneath at least part of the user's head when the user's head and neck is placed on the pillow. Any of the aspects and embodiments described herein may suitably comprise such elongate body portions.

The neck support member may suitably comprise one or more elongate body portions, such as one. Where only one is provided, the first and second body portions will form a structure that is asymmetrical in length in that one of the first or second body portions will be longer than the other respective portion and thus will extend over the respective pillow face more than the respective other portion. Where more than one elongate portion is provided, each may be of similar or dissimilar dimensions relative to the other (e.g. length, width and/or thickness), such as equal or unequal length, width and/or thickness, typically substantially uneven. Where more than one elongate body portion is provided, i.e. where each neck support member body portion has an elongate portion, the respective first and second portions of the neck support member may still be asymmetrical in length as described above, or may be substantially symmetrical, such as entirely symmetrical in length, i.e. where the length of the elongate portions of the first and second body portions are able to extend the respective body portions over the respective pillow faces by the same distance.

Suitably, where the first body portion comprises an elongate body portion, the elongate body portion may be useable so as to be disposed directly underneath the head (e.g. in contact with the head) and support the user's head in use.

Each elongate body portion may in practice comprise an integrated/single piece of core material, or may comprise multiple core components formed so as to provide an elongate body portion.

The presence of an elongate body portion of the invention in any aspect and embodiment disclosed herein provides additional versatility in that although an elongate body portion extends to cover a surface area of the main pillow body on which a user's head may be placed in use, the elongate body portion need not be in fact used to actually contact and support the head of the user in practice. For instance, in embodiments wherein the second body portion extends around the main pillow body edge to cover at least part of an second opposing main pillow face, the elongate second body portion may extend over the opposing face of the main pillow body (i.e. underneath the pillow in use) so as to contact the surface on which the neck support pillow is placed in use. This arrangement provides increased anchoring of the neck support member underneath the pillow, particularly when the pillow is compressed by the head in use, thus further reducing movement of the neck support member relative to the pillow when in use. It also provides a base layer of support to the main pillow body without affecting the 'feel' of the pillow. Depending on the thickness of the elongate portion, this may also help to raise the pillow and add extra bulk for supporting the neck (i.e. by biasing the neck towards a neutral spinal posture).

The thickness of the (or at least one, or each) elongate body portion may be as defined herein for the neck support member/the first and/or second body portions in general. Typically, the (or at least one, or each) elongate body portion has a substantially uniform thickness throughout. This has the advantage of providing a substantially even surface for supporting the head, or a substantially even surface on which the main body pillow is placed. Where two elongate portions are present, i.e. one for contacting the user's head and one for contacting the base surface on which the pillow body is placed, it is preferred that both independently have a substantially uniform thickness. Suitably, each elongate body portion may have an entirely uniform thickness.

In embodiments, the thickness of the elongate body portion of the first and/or second neck support body portion (s) is less than the thickness of the part of the respective first and/or second body portions of the neck support member that is disposed to cover the pillow body face in the region adjacent to the pillow. In other words, in embodiments, the thickness of the part of a neck support body portion covering the part of the main pillow body face adjacent the pillow edge may be greater than the thickness of the elongate body portion in the region configured to contact the head. In other words, the outer surface of the first body portion adjacent the pillow edge typically extends toward the recess of the neck relative to the pillow surface to greater extent than the elongate body portion extends from the surface of the main pillow body to the head in use. This allows for improved conformity of the outer, i.e. neck contacting, surface of the neck support member with the recess of the neck when the user's head is placed on the pillow. However, in embodiments, the thickness of the elongate body portion may be substantially the same as the first body portion and/or the second body portion. For instance, in some embodiments, the thickness of the entire neck support body portion may be substantially the same. This may provide for ease of manufacture.

Suitably, each elongate body portion may independently be configured to extend over at least half of the width of a face of the main pillow body, such as at least 60% of the width of a face, suitably at least two thirds of the width of a face, preferably at least 75%, at least 80%, more preferably at least 90%, such as substantially the entire width of a face of a main pillow body (e.g. at least 95% or at least 98% of the entire width of a face). In embodiments, the elongate portion is configured to extend over at least the entire width of a face of the main pillow body.

The elongate body portion may extend over the width of the main pillow face away from the pillow edge (i.e. toward the opposing pillow edge) up to around 70 cm, 65 cm or 60 cm, such as up to around 55 cm, 50 cm, 45 cm, 40 cm, 35 cm, 30 cm, or 25 cm, such as up to 20 cm, 18 cm, 16 cm, for instance up to 15 cm, for instance up to 10 cm, or up to 5 cm. Typically, the elongate body portion may extend over the width of the main pillow face away from the pillow edge no more than 66 cm. Preferably, the (or each) elongate body portion may extend over the width of the main pillow face to width of around 47 cm.

Typically, each elongate portion independently extends over the main pillow body surface away from the pillow edge such that the distance from the pillow edge (i.e. the edge of the main pillow body) to the portion of the elongate member farthest from the pillow edge is at least 10 cm. In this context, the pillow edge refers to the pillow edge over which the neck support member, i.e. the second body portion of the neck support member extends over from the first body portion. The distance may for instance be at least 12 cm, 14 cm, 16 cm, 18 cm, 20 cm, 25 cm, 30 cm, 35 cm, 40 cm, 45 cm, 50 cm, 55 cm, or at least 60 cm. The distance may for instance be around 35 cm, 47 cm, 51 cm, or 65 cm, which are typical widths for a pillow in the marketplace. In embodiments, the distance may be at least 68 cm or 70 cm. For instance, the distance may in embodiments exceed the width of the pillow face. Preferably the distance is less than the width of the pillow case and most preferably is around 47 cm as this length has been found to provide a desirable balance between comfort, support, frictional contact and bulk. In embodiments, the distance may for instance be no more than 70 cm, such as no more than 68 cm, 66 cm, 65 cm, 60 cm, 60 cm, 55 cm, 50 cm, 45 cm, 40 cm, 35 cm, or 30 cm, such as no more than 28 cm, 26 cm, 25 cm, 24 cm, 22 cm, 20 cm, 18 cm or 16 cm.

Preferably, the elongate portion does not extend (or is not useable so as to extend) over the edge of the main pillow body opposite the main pillow body edge over which the second body portion extends from the first body portion in accordance with the aspects and embodiments above. In other words, in embodiments, the elongate portion of the first and/or second body portion does not extend over the opposite edge of the pillow. This provides the advantage that the neck support member can provide adequate support for the head and neck in use but is also relatively lightweight. Surprisingly, the inventor also found that this arrangement provides enough frictional contact between the neck support member and the main pillow body to provide surprisingly effective mitigation of movement of the neck support member relative to the main pillow body whilst simultaneously better retaining the feel and response of the original main pillow body compared to embodiments wherein the elongate portion extends around the opposing edge to cover the opposing face of the pillow. This arrangement also means that the neck support member can be more versatile since the absolute dimensions of the elongate member need not be matched to any specific pillow width and there is thus less likely to be a large amount of excess material that is not contributing to the technical effect of the invention. This feature also avoids the additional bulk associated with extra padded material passing over another pillow edge, which would otherwise increase the overall width of the pillow, making it a tighter fit inside a regular pillow case.

Neck Support Member Body Length

Figure 1B:
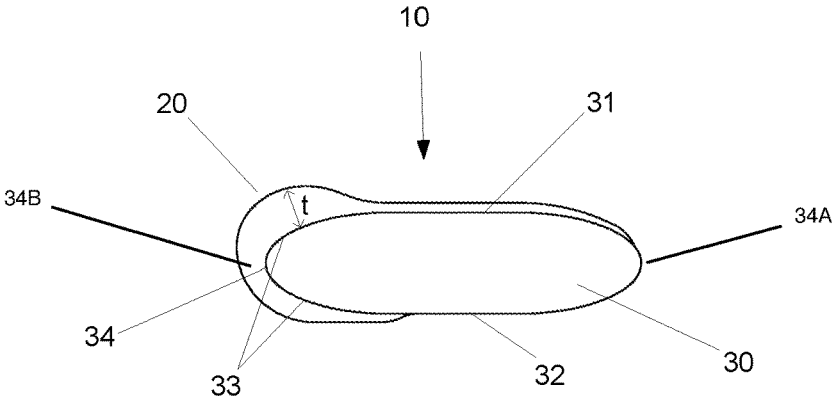
Figure 1C:
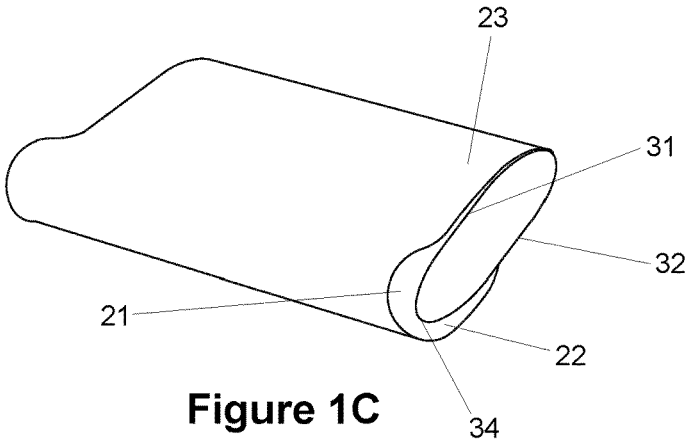
Figure 2A:
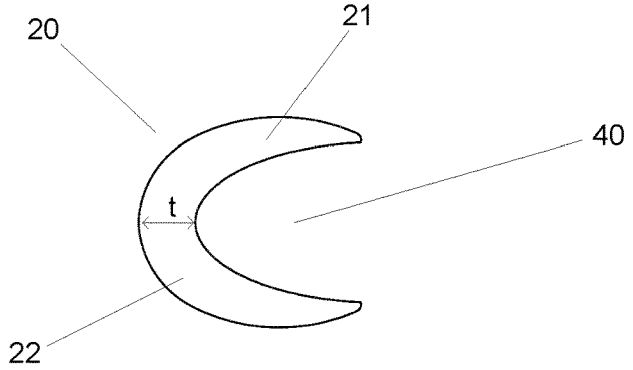
FIG. 2 depicts in A) a cross-sectional or side view of a neck support member of the invention wherein the first and second body portions/jaw members are of identical length and thickness proportions so as to provide a symmetrical neck support member; in B) a cross-sectional/side view illustration of the neck support member of FIG. 2A releasably engaged to a main pillow body to form a neck support pillow; and in C) a perspective illustration of the neck support pillow of FIG. 2B.
Figure 2B:
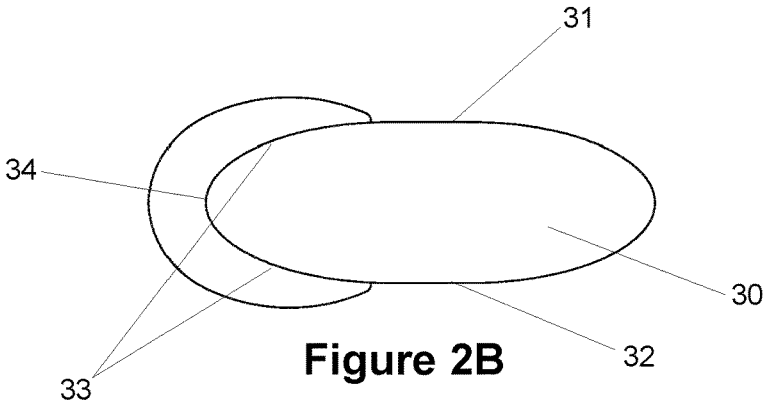
Figure 2C:
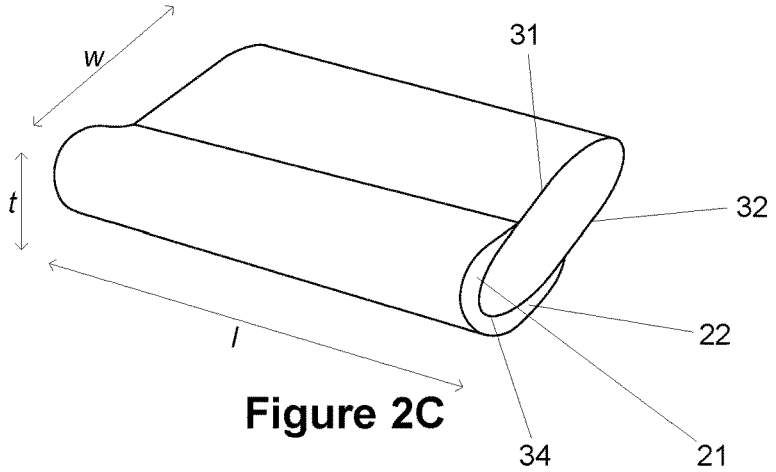
Figure 3A:
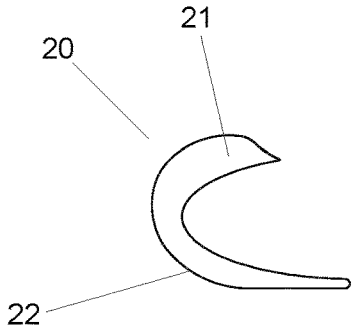
FIG. 3 depicts in A) a cross-sectional or side view of a neck support member of the invention wherein the second body portion/jaw member is configured to be usable so as to extend over the second face farther than the first body portion extends over the first face, wherein the first body portion is thicker in the region adjacent the edge than the corresponding part of the second body portion and wherein part of the second body portion extending over the second pillow face (i.e. under the pillow) has a flat outer surface profile; in B) a cross-sectional/side view illustration of the neck support member of FIG. 3A releasably engaged to a main pillow body to form a neck support pillow; and in C) a perspective illustration of the neck support pillow of FIG. 3B.

In this portion, the "length" of the neck support member refers to the length that it extends along the pillow edge (as opposed to the distance it extends over the width of the pillow face towards the opposing edge), i.e. as indicated by length "l" in FIG. 2C. The neck support member needs only to cover and extend along a length of the pillow edge large enough to be as wide as a user's neck in use, meaning that the neck support member needs only to cover a part of the entire length of the pillow edge. It is thus not essential for the entire length of said pillow edge to be engaged by the neck support member, although the exemplary embodiments illustrated in FIGS. 1C, 2C and 3C are configured so as to extend along the entire length of the main pillow edge. In embodiments of the present disclosure, the neck support member may thus be adapted to engage (such as to substantially encase, e.g. entirely encase) less than half of the entire length of said pillow edge in use. In alternative embodiments, the neck support member is suitably adapted to engage (such as to substantially encase, e.g. entirely encase) around half of the entire length of said pillow edge in use. The neck support member may suitably be adapted to engage (such to substantially encase, e.g. entirely encase) more than half of the entire length of the pillow edge in use, such as at least two thirds of the entire length of the pillow edge. In embodiments, the neck support member is adapted to engage (such as to substantially encase, e.g. entirely encase) substantially the entire length of the pillow edge (such as at least 90%, 95%, or 98% of the entire length of the pillow edge), for instance the neck support member may be adapted to substantially encase (e.g. entirely encase) the entire length of the pillow edge in use. Neck support members that substantially encase (e.g. entirely encase) a significant part of the length of the pillow edge have the advantage that support for the neck may be still provided even allowing for lateral movement of the user's neck along the length of the pillow edge during sleep (i.e. the user will not roll off the neck support member).

Exemplary bed pillow length dimensions that are typically available in the marketplace are presented above under main pillow body. The main pillow body of the neck support pillows of the present disclosure may thus suitably be substantially (e.g. exactly) according to any of such dimensions.

The neck support member in suitable embodiments extends along the edge of the main pillow body by at least 20 cm (so as to provide adequate support for the entire width of an average user's neck). The references to engaging or covering a given % of the entire length of the pillow edge mentioned above may thus refer to the main pillow body lengths as described herein above. In embodiments, the neck support member has a length (i.e. such that it extends along the pillow edge when in engagement with the pillow edge), from around 20-95 cm, such as a length selected from the group consisting of from 55 65 cm, from 60-70 cm, from 70-80 cm, and from 85-95 cm. The neck support member may thus have a length of at least about 50 cm, 60 cm, 65 cm, 70 cm, 75 cm, 80 cm, 85 cm, 90 cm, or at least 95 cm. The neck support member of the present disclosure may, for instance, have a length of no more than about 50 cm, 55 cm, 60 cm, 65 cm, 70 cm, 75 cm, 80 cm, 85 cm, 90 cm or no more than 95 cm. In typical embodiments, the neck support member length may be around 57 cm, 65 cm, 66 cm, 76 cm or 91 cm, and preferably no more than 91 cm. In most preferred embodiments, the length of the neck support member (i.e. corresponding to the length of the main pillow body engaged by the neck support member in use) is around 70 cm.

Neck Support Member Body Recess/Cavity

In the aspects and embodiments disclosed herein, the neck support member is adapted to extend over an edge of the pillow. Thus, in other words, the first and second body portions of the neck support member are disposed in use so as to define an internal recess having an inner surface (i.e. generally concave surface) for engaging the main pillow body edge and a portion of at least one face of the main pillow body adjacent the edge of the main pillow body.

The recess/cavity in the neck support body is adapted to engage an edge of a main pillow body. In other words, the recess/cavity is configured such that when in use, the pillow edge may be received in the cavity such that the inner cavity surface may contact the outer edge of the main pillow body, e.g. in a male-female type docking arrangement. In preferred embodiments, the cavity is an elongate groove formed by the curvature of the first and second body portions. The groove may extend along substantially the entire body length (such as at least 90%, at least 95 or at least 98%) of the neck support member. More preferably, the elongate groove extends along the entire body length of the neck support member body. In embodiments where the groove extends along the entire length of the neck support member body, the neck support member can be more readily used with a more diverse range of pillows since the entire length of the main pillow edge does not need to be contained entirely within the groove and can extend outwards in a lateral plane past the ends of the neck support member in use (i.e. the neck support member can be used with pillows that have a main pillow body edge length longer than the length of the neck support member). Moreover, this arrangement allows for greater flexing of the distal ends of the first and second lateral portions away from each other (in an open jaw-like fashion) enabling a given neck support member to engage a more diverse range of main pillow body thicknesses, i.e. the cavity volume of the neck support pillow need not be tailored to closely match the pillow edge thickness.

Typically, the cavity defines an "inner surface profile" of the neck support member. The inner surface profile may be a substantially concave inner surface. By "substantially" concave, it is meant that the inner surface may not be perfectly concave or perfectly curved. For instance, the inner cavity surface may comprise one or more side walls that are substantially flat. Preferably, the inner cavity wall thus does not define a "C"-shaped cross section. The cavity may for instance define a substantially "r"-shaped, "V"-shaped or "U" shaped internal body cross-section, optionally "U"- or "V"-shaped, preferably "U" shaped, i.e. wherein the cavity side walls (i.e. the cavity walls representing the inner surface of the first and second body portions) are not substantially curved. Typically, in such embodiments, at least a portion of the inner cavity surface is curved, e.g. in the case of a "U"-shaped cavity, so as to provide better conformity with the pillow edge. Embodiments having less curvature in the side walls of the inner cavity (i.e. the inner surfaces of the first and second lateral body portions) have the advantage that they are able to provide neck support for a greater diversity of pillow edge shapes and thicknesses, and are particularly suited to use with conventional pillows. Neck support pillows having a largely "C"-shaped cavity (i.e. wherein the side walls of the cavity are curved), for instance, can form a void in the upper and lower parts of the "C" when the main pillows used do not exhibit a complementary-curved shaped contour. This void can thus collapse in use causing more significant deformation of the neck support member in use, leading to a less reliable engagement between the pillow and neck support member, and/or providing a less desirable level of neck support. The curvature on the bottom of the pillow edge may also detrimentally affect comfort.

To put it a different way, in the above embodiments, the cavity thus defines a mouth portion and the first and second body portions represent first and second jaw members. Thus, statements provided above in respect of first and second body portions may also apply to the first and second jaw members analogously.

Figure 5:
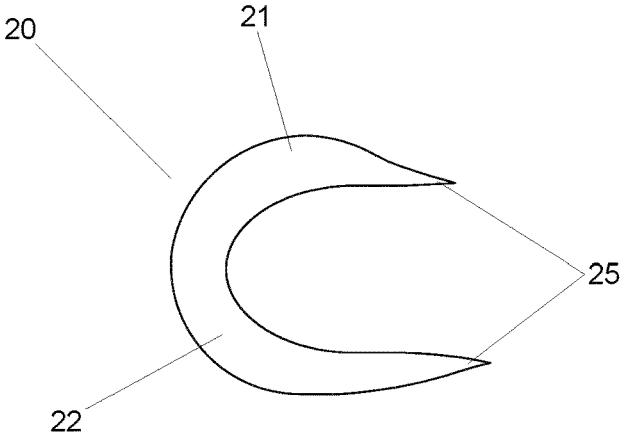
FIG. 5 depicts a cross sectional/side view illustration of a neck support member of the invention wherein both the first and second body/jaw members are tapered at their terminal ends.

Thus, in preferred embodiments, the neck support member according to any aspect or embodiment herein may be configured such that the first and second body portions represent first and second jaw members having an open mouth end a closed end (see, e.g. FIGS. 2A, 5, etc. the jaw members thus defining side walls of an inner recess, the recess being useable so as to receive a pillow edge and the first and second jaw members are useable to releasably engage a pillow edge in use. In this regard, where the present application refers to "first and second body portions", these may respectively be understood in preferred embodiments to refer to first and second jaw members defining an inner recess. In preferred embodiments, the inner recess is as described herein, e.g. it may be a groove. Thus, where properties are recited herein for the first and second body portions, these may likewise be taken to apply to the first and second jaw members.

The inner surface of the neck support member adapted to contact the main pillow body surface (i.e. the inner cavity surface) may have a regular or irregular surface for contacting the main pillow body in use. In this regard, where the cavity is referred to as having a substantially concave cross section, such as an "r", "U" or "V"-shaped cross section, in embodiments a "U" or "V"-shaped cross section, optionally "U", it is intended that this refers to the primary surface profile of the inner surface. Indeed, the primary surface may contain secondary surface features that may not be substantially concave in themselves or which my not conform to an "r, "U" or "V" shape themselves, provided the primary inner surface profile for contacting the main pillow body conforms to this shape. For instance, the neck support member may be provided with secondary surface profile features, such as additional projections or adornments on its inner cavity surface, such as to provide a better engagement with a pillow edge in use.

Preferably, the cavity is absent of secondary surface profile features, other than the minor material surface defects that may be inherent to the surface material. For instance, in preferred embodiments, the inner cavity has a regular surface area for contacting the pillow in use. In embodiments, the inners cavity surface is substantially smooth, or entirely smooth.

The cavity therefore suitably defines an inner surface of the neck support member wherein the inner surface of the first body portion is adapted to contact the first (e.g. head-contacting) face of the main pillow body adjacent an edge of the main pillow body in use, and the inner surface of the second body portion is adapted to contact the edge, and preferably the opposing (e.g. surface-contacting), face of the main pillow body adjacent an edge of the main pillow body in use. It will be appreciated that the inner cavity surface may be shaped to substantially mirror the outer surface of the neck support member. The surface profile of the inner cavity walls and the surface profile of the outer surface of the neck support member may be different, e.g. the inner cavity may be substantially U-shaped, whereas the outer surface profile may be curved in the edge region disposed so as to be contactable by the neck of the user but having a flat base.

In embodiments of any of the aspects and embodiments disclosed herein, the parts of the neck support member adjacent the edge of the main pillow edge and extending over the edge of the main pillow body that are disposed to contact a subject in use may have a curved outer surface profile that is substantially convex (i.e. outwardly curved) for contacting the neck in use.

The term "outer surface profile" is as described above for the second aspect and its embodiments. Thus, the outer surface profile according to any aspect and embodiment described herein may be as defined according to any of the above embodiments of the outer surface profile described above. Furthermore, the advantages associated with this feature are also described above for the first embodiment.

The outer primary curved surface may be of any suitable gradient of curvature provided the surface is able to at least partially conform to the recess of a user's neck. In embodiments, the gradient of curvature is such that the outer surface of the first and second portion substantially reflects (i.e. is substantially the same as) the outer surface profile at the edge of the main pillow body. In embodiments, the gradient of curvature of the outer convex face may be substantially similar (such as identical) to the inner concave surface curvature of the neck support member cavity/recess that accepts the main pillow body. It will be appreciated however that in use, the internal shape of the recess for a given neck support member may vary depending on the thickness of the main pillow body. If the neck support member is used with a main pillow that is relatively thick, the first and second neck support body portions (i.e. the first and second jaw members) may be forced apart (e.g. to adopt a wide "V-shape" or wide "U" shape), whereas for relatively thinner pillows, the first and second body portions may be relatively closer together (e.g. to adopt a "U-shape" or narrow "V"-shape).

Suitably, the neck support member of the present aspect and embodiments thus does not include an upper back/shoulder ramp.

Neck Support Member Materials

In aspects and embodiments of the present disclosure which refer to a neck support member, the neck support member typically comprises suitable pillow filler materials e.g. fillers/padding/stuffing. For instance, the neck support member may have an outer surface and a body core, the core comprising suitable filler materials. The suitable pillow filler materials may be as described above for the first or second neck support member body portions.

Core materials that are deformable in themselves during normal use of the pillow may suitably be provided in particulate form, or may more preferably be provided as a single core piece, such as a core formed as a single piece (e.g. by carving or moulding) or formed by integration of multiple pieces, such as by adhesion of multiple layers of core filler material, e.g. lamination, to form a single piece having multiple integrated parts.

Support for the Neck

The neck support members of the present invention provide additional neck support when combined with pillows compared to when the pillows are used alone, particularly compared to pillows that are thinner at the edges, such as conventional pillows, e.g. conventional bed pillows, or pillows that only provide a thin layer of padding throughout.

As described above, the density of a material is important for providing support for the user's head and neck, and the firmness of a material tends to have an important effect on whether the material has a desirable feel.

The firmness of a given material is closely associated with the potential for surface pressure reduction. The firmness of a material, such as memory foam, may be quantified in terms of Indention Force Deflection (IFD) which is discussed further above.

The density of the main pillow body core material (e.g. memory foam) may be quantified as pounds per cubic feet ("Lbs/ft$^3$", also denoted as "pcf" in some published material). The higher the foam density of the core material, the more support it will provide to the user's head a neck and the more durable it will be.

A general indication of the amount of neck support provided by the neck support members of the present invention may be provided for instance by comparing the amount of force required to cause the portion of the main pillow body adjacent the pillow edge covered by the neck support pillow to compress to a predetermined level, e.g. by 10%, 25% or 50% of the thickness of the original pillow. The neck support members of the present invention thus provide an increased level of support in the neck region relative to the pillow alone, for instance compared to conventional pillows.

In particular, neck support pillows of the present invention comprising neck support members of the invention show an increase in resistance to compression at the portion of the pillow covered by the neck support member compared to conventional pillows provided without the neck support member of the invention. In embodiments, the neck support members of the present disclosure may show at least 5% increase in resistance to compression of the pillow edge, such as at least 10%, in embodiments at least 15%, such as at least 20%, at least 30%, at least 40% or at least 50% compared to the pillow alone.

The skilled person reading the present application will appreciate that the level of additional support can be controlled and affected by varying the type of filler material within the neck support pillow body, the density of the filler material, and the thickness of the neck support member body portion, including thickness of each of the first and second body portions. For instance, increasing the thickness of the first (i.e. neck contacting) neck support member body portion will increase the height and cushioned support for the neck. Increasing thickness of the body portion on which the pillow is placed in use (i.e. surface contacting body portion) will increase the elevation of the pillow edge, thus bringing the upper surface of the first body portion closer to the neck and increasing the structural support at the pillow edge.

Increasing the thickness/density of the second (i.e. edge) body portion of the neck support member can also have an impact the support function of the neck support member. Increasing the thickness of the second body portion at the region where it passes over the edge of the pillow will increase the lateral distance from the pillow edge to the user's neck/back/shoulder in use. For instance, the second body portion extending over the pillow edge provides a supportive pillar function in use, thus supplementing the neck support of the neck support member. The thickness of the second (i.e. edge) body portion of the neck support member can also impact the level of support by helping support the shoulder of the user by keeping it more upright, which also in turn supports the neck. Typically, this side body portion will be configured so as to "dome outwards" towards the user's shoulder. In embodiments, the part of the first body portion that contacts a user's neck in use may be of a substantially uniform thickness such that it does not form a conventional neck contour shape.

The overall level of neck support can therefore be affected by a combination of factors and it will be apparent to a skilled person reading this disclosure that the dimensions of the neck support member can be tailored to provide a desired level of neck support and/or cushioning.

In preferred embodiments, the overall support of the neck support pillow (e.g. as measured by the methods above, or as indicated by overall pillow thickness) at the region adjacent the pillow edge on which the neck is to be placed in use is typically around the same level of support (or thickness) provided by a typical orthopaedic pillow, and is preferably no more than that provided by a typical orthopaedic pillow. In embodiments, the body portion of the neck support member that is disposed so as to contact the user's neck in use is thicker at the region adjacent the edge of the main pillow body (e.g. within 0-5 cm of the main pillow body edge) than the region of the body portion distal to the edge of the main pillow body. This may advantageously allow the neck support member to impart a contour pillow effect when engaged with a main pillow body that does not have a contour effect.

Form of the Neck Support Member

In embodiments, the neck support member may be formed from a single (e.g. flat) piece of material that is formed (e.g. curved) into a shape useable as a neck support member according to the present claims by the user. A tailored pillow case may for instance force the material piece into the respective shape to form a preformed neck support member, or the material may for instance be mouldable so as to form and hold the respective shape when forced into shape by a user.

Suitably, in embodiments where the neck support member covers (or is configured so as to be useable to cover) at least a part of a first face of the main pillow body adjacent to the edge and extends over the main pillow edge to cover at least part of the second, opposing face of the main pillow body adjacent the edge, the neck support member may extend over the first pillow face to a lesser or greater extent than it extends over the opposing face (i.e. the second face). In embodiments, the neck support member extends over the first face around the same distance as the opposing face (i.e. the second face). Thus, an elongate member may in embodiments allow for the respective first or second body portion to extend over the main pillow face. In this regard, the respective first body portion may thus cover an area of the first face of the main pillow body that is different to the area of the second pillow face covered by the second body portion. In alternative embodiments, the respective first and second body portions cover substantially the same surface area of the respective first and second faces of the main pillow body.

By reference to a neck support member body surface that is suitable for supporting the head of the user, it is typically intended that an elongate portion is configured to extend over at least enough of the pillow face so as to cover a surface area large enough to encompass an area of a main pillow face that is eclipsed by a user's head when the user's head is placed on the pillow and the user's neck is supported by the neck support member.

Suitably, the neck support members of the present disclosure may be formed of multiple separate components integrated to form a single piece (e.g. by lamination). For instance, the first and second body portions may be provided as separate components integrated into a single piece. Preferably, the neck support member of the present invention is formed as a single piece. For instance, the neck support member may be moulded or sculpted as a single piece. Suitably, the neck support member may be provided with an outer layer or shell, such as a fitted pillow case, whether or not the neck support member is made of single or multiple pieces.

In preferred embodiments, the shape of the neck support member as defined herein is pre-formed. By pre-formed, it is meant that the default (i.e. resting) shape of the neck support member, i.e. the shape provided when the user is not resting their head and neck on the pillow in use is capable of engaging a pillow edge and is substantially or entirely pre-defined (and thus not solely formed as result of manipulation of the neck support member during use). This preformation of the neck support member may be provided by any suitable fabrication method, such as by moulding or sculpting. The pre-formed shape may alternatively be provided by way of providing an outer skin layer, such as a pillow case that forces the filler material into a form ready for engagement with a pillow edge. In this case, the core may be filled with a particulate filler material (such as air or foam chips, etc.) or it may be a solid piece held in a shape so as to form the predefined shape once the outer layer has been filled. For instance, the neck support member may in embodiments be provided as a substantially flat pad or sheet or material which may then be hand formed (e.g. moulded or rolled) to provide the neck support members configured to engage the pillow edge as described herein. To assist in retaining the neck support member in position in circumstances where the material is not disposed to retain the neck support member shape in the absence of the main pillow body, a means of releasable connection to the main pillow body may be provided (e.g. by way of a tether, adhesive, or, for instance, Velcro).

Further Embodiments of the Neck Support Member

In embodiments, at least one of the first and second body portions has an end body terminus (i.e. terminal end) that is tapered, e.g. tapered towards the main pillow body surface (see, e.g. FIG. 5). Preferably, where a portion is tapered, at least the part of the neck support member that is disposed to contact the user's neck/head is tapered (so as to provide an improved integrated feel). This taper may suitably provide a smoother, less noticeable transition between the neck support member and the main pillow body that may improve integrated feel when the tapered end terminus of the neck support member is in a region disposed to be eclipsed by the neck or head in use. As indicated in FIG. 5, the tapered end terminus may suitably be the part of the neck support member that marks the farthest point at which the body of the neck support member extends over the main pillow body face away from the edge of the main pillow body which the neck support member is releasably engaged to in use.

In general, the size dimensions, e.g. length, width and thickness of the neck support member of the present invention are as described above for the first and second body portions (as well as elongate portions). The materials and functions are suitably also be as described above for the first and second body portions.

The body thickness of the neck support member's second body portion may in embodiments be as described generally above according to any embodiment of the first body portion. The second body portion (including the edge part and the face part as described above) may have a body thickness that is different to the first body portion. In embodiments, the second body portion (including the edge part and the face part as described above) may have a body thickness that is substantially the same, such as exactly the same body thickness as the first body portion. In an embodiment, the thickness of the entire neck support body portion is substantially the same, e.g. entirely the same throughout.

Fifth Aspect

In an aspect of the invention is provided a neck support member substantially as herein described above for use in preparing a neck support pillow as described according to any one of the aspects or embodiments herein.

Accordingly, in such embodiments, the neck support member may or may not be provided in releasable engagement with a pillow as described above for the neck support pillows of the invention. Such neck support members per se thus have utility in preparing neck support pillows of the invention and the advantages associated with these products are described in detail above.

Where features and characteristics of the neck support member of the neck support pillows are described above in relation to their position relative to a main pillow body, the skilled person will appreciate in this aspect that the main pillow body is not itself part of the aspect. Thus, where embodiments are described above as performing an active function relative to a pillow (e.g. covering, or engaging), or of having a size or dimension relative to such pillows, it is intended for the purpose of this aspect that the respective physical features are suitably configured for such use (e.g. configured so as to be useable to cover, or configured so as to engage), i.e. disposed so as to be useable as stated (e.g.

disposed so as to be useable to cover, or disposed so as to be useable to engage), but not necessarily provided in a functionally active form, i.e. as engaged to a main pillow or in active use by a user.

Suitably, in an embodiment is provided a neck support member having a first body portion and a second body portion extending from an end of the first body portion, the first body portion configured (e.g. shaped) so as to be useable to cover at least part of a first (e.g. head-contacting) face of a main pillow body adjacent an edge of the main pillow body; and the second body portion disposed relative to the first body portion so as to be useable to extend over the edge of the main pillow body from the first body portion toward the second pillow face, wherein the first and second body portions when disposed as such in use provide a raised surface relative to the main pillow body surface for supporting the neck;

wherein the first body portion of the neck support member comprises an elongate body portion configured relative to the first and second body portions so as to be useable when the neck support member is engaged to a main pillow edge in use to extend over a face of the main pillow body to cover at least part of a first face of the main pillow body adjacent the pillow edge and configured so as to be useable such that at least part of the elongate member extends underneath at least part of the user's head when the user's head and neck is placed on the pillow in use, and/or wherein the second body portion of the neck support member comprises an elongate body portion configured relative to the first and second body portions so as to be useable when the neck support member is engaged to a main pillow edge in use to extend over a face of the main pillow body to cover at least part of a second face of the main pillow body adjacent the pillow edge and configured so as to be useable such that at least part of the elongate member extends underneath at least part of the user's head when the user's head and neck is placed on the pillow in use. This embodiment corresponds to the neck support member described in the first aspect and embodiment above and the features of the neck support member may be described according to any embodiment of neck support member of the first aspect or any other embodiments of the neck support member described herein. The advantages associated with this embodiment are also thus described above for the first aspect and embodiments.

In an alternative embodiment is provided a neck support member having a first body portion and a second body portion extending from an end of the first body portion, the first body portion configured (e.g. shaped) so as to be useable to cover at least part of a first (e.g. head-contacting) face of a main pillow body adjacent an edge of the main pillow body; and the second body portion disposed relative to the first body portion so as to be useable to extend over the edge of the main pillow body from the first body portion toward the second pillow face, wherein the first and second body portions when disposed as such in use provide a raised surface relative to a main pillow body surface for supporting the neck;

wherein the parts of the neck support member that are configured so as to a) be disposed to cover a part of a first face of the main pillow body adjacent the edge of the main pillow body; and b) extend over the edge of the main pillow body toward the second face when the neck support pillow is engaged to a main pillow edge have a curved outer surface profile that is substantially convex (i.e. outwardly curved) so as to be useable to contact the user's neck when the neck pillow body is engaging a main pillow body edge and the user's head is placed on the pillow in use. This embodiment corresponds to the neck support member described in the second aspect and embodiment above and the features of the neck support member may be described according to any embodiment of neck support member of the second aspect or any other embodiments of the neck support member described herein. The advantages associated with this embodiment are also thus described above for the second aspect and embodiments.

In another alternative embodiment is provided a neck support member having a first body portion and a second body portion extending from an end of the first body portion, the first body portion configured (e.g. shaped) so as to be useable to cover at least part of a first (e.g. head-contacting) face of a main pillow body adjacent an edge of the main pillow body; and the second body portion disposed relative to the first body portion so as to be useable to extend over the edge of the main pillow body from the first body portion toward the second pillow face, wherein the first and second body portions when disposed as such in use provide a raised surface relative to a main pillow body surface for supporting the neck;

wherein the outer surface of the second body portion is configured such that when the neck support member is in engagement with a main pillow body edge in use, the outer surface of the second body portion projects in a direction directly away from the main pillow body no more than about 10 cm from the main pillow body edge (i.e. toward the user). This embodiment corresponds to the neck support member described in the third aspect and embodiment above and the features of the neck support member may thus be described according to any embodiment of neck support member of the third aspect or any other embodiments of the neck support member described herein. The advantages associated with this embodiment are also thus described above for the third aspect and embodiments.

In a further aspect is provided a neck support member having a first body portion and a second body portion extending from an end of the first body portion, the first body portion configured (e.g. shaped) so as to be useable to cover at least part of a first (e.g. head-contacting) face of a main pillow body adjacent an edge of the main pillow body; and the second body portion disposed relative to the first body portion so as to be useable to extend over the edge (i.e. the edge disposed to contact the user's neck when the head is placed on the pillow in use) of the main pillow body from the first body portion toward the second pillow face, wherein the first and second body portions when disposed as such in use provide a raised surface relative to the main pillow body surface for supporting the neck;

wherein the neck support member has an outer surface and an inner core, the core consisting essentially of one or more materials that are deformable during normal use of the pillow. This embodiment corresponds to the neck support member described in the fourth aspect and embodiment above and thus the features of the neck support member may be described according to any embodiment of neck support member of the fourth aspect or any other embodiments of the neck support member described herein. The advantages associated with this embodiment are also thus described above for the fourth aspect and embodiments.

The neck support member of the present aspects and embodiments are configured so as to be releasably engageable with an edge of a main pillow body. In this aspect and embodiments, reference to the neck support pillow engaging a main pillow body is intended to refer to an engagement as described above in relation to the neck support pillows of the invention, e.g. such as described in aspects 1-4 and the figures.

The neck support pillow members recited in the fifth aspects and embodiments are suitable for providing an increased neck support at a pillow edge relative to the support provided by the pillow alone.

In preferred embodiments, the neck support member of the invention is suitable for releasably engaging a main pillow body edge and comprises first and second body portions that represent first and second jaw members defining a recess having an open mouth portion for receiving the edge of the main pillow body, an inner surface for releasably engaging the main pillow body edge, and a closed body portion for containing the main pillow body edge (see, e.g. FIGS. 2A, 5, etc.). Thus, the recess is useable so as to receive a pillow edge and the first and second jaw members are useable to releasably engage a pillow edge in use. In this regard, where the present application refers to "first and second body portions", these may respectively be understood in preferred embodiments to refer to first and second jaw members defining an inner recess. In preferred embodiments, the inner recess is as described herein, for instance it may be a recess that extends along a long axis of the next support member, e.g. it may be a groove. Thus, where properties are recited herein for the first and second body portions, these may likewise be taken to apply to the first and second jaw members.

The inner surface of the neck support member adapted to contact the main pillow body surface (i.e. the inner cavity surface) may have a regular or irregular surface for contacting the main pillow body in use. In this regard, where the cavity is referred to as having a substantially concave cross section, such as an "r", "U" or "V"-shaped cross section, in embodiments a "U" or "V"-shaped cross section, optionally "U", it is intended that this refers to the primary surface profile of the inner surface. Indeed, the primary surface may contain secondary surface features that may not be substantially concave in themselves or which my not conform to an "r, "U" or "V" shape themselves, provided the primary inner surface profile for contacting the main pillow body conforms to this shape. For instance, the neck support member may be provided with secondary surface profile features, such as additional projections or adornments on its inner cavity surface, such as to provide a better engagement with a pillow edge in use.

Preferably, the cavity is absent of secondary surface profile features, i.e. macro features other than the usual minor material surface defects that may be inherent to the surface material. For instance, in preferred embodiments, the inner cavity has a regular surface area for contacting the pillow in use. In embodiments, the inners cavity surface is substantially smooth, or entirely smooth.

The cavity therefore suitably defines an inner surface of the neck support member wherein the inner surface of the first body portion is adapted to contact the first (e.g. head-contacting) face of the main pillow body adjacent an edge of the main pillow body in use, and the inner surface of the second body portion is adapted to contact the edge, and preferably the opposing (e.g. surface-contacting), face of the main pillow body adjacent an edge of the main pillow body in use. It will be appreciated that the inner cavity surface may be shaped to substantially mirror the outer surface of the neck support member. The surface profile of the inner cavity walls and the surface profile of the outer surface of the neck support member may be different, e.g. the inner cavity may be substantially U-shaped, whereas the outer surface profile may be curved in the edge region disposed so as to be contactable by the neck of the user but having a flat base.

In embodiments of any of the aspects and embodiments disclosed herein, the parts of the neck support member adjacent the edge of the main pillow edge and extending over the edge of the main pillow body that are disposed to contact a subject in use may have a curved outer surface profile that is substantially convex (i.e. outwardly curved) for contacting the neck in use.

The term "outer surface profile" is as described above for the second aspect and its embodiments. Thus, the outer surface profile according to any aspect and embodiment described herein may be as defined according to any of the above embodiments of the outer surface profile described above. Furthermore, the advantages associated with this feature are also described above for the first embodiment.

The outer primary curved surface may be of any suitable gradient of curvature provided the surface is able to at least partially conform to the recess of a user's neck. In embodiments, the gradient of curvature is such that the outer surface of the first and second portion substantially reflects (i.e. is substantially the same as) the outer surface profile at the edge of the main pillow body. In embodiments, the gradient of curvature of the outer convex face may be substantially similar (such as identical) to the inner concave surface curvature of the neck support member cavity/recess that accepts the main pillow body. It will be appreciated however that in use, the internal shape of the recess for a given neck support member may vary depending on the thickness of the main pillow body. If the neck support member is used with a main pillow that is relatively thick, the first and second neck support body portions (i.e. the first and second jaw members) may be forced apart (e.g. to adopt a wide "V-shape" or wide "U" shape), whereas for relatively thinner pillows, the first and second body portions may be relatively closer together (e.g. to adopt a "U-shape" or narrow "V"-shape).

Sixth Aspect

In an aspect of the invention is provided the use of a neck support member as defined according to any of the aspects and embodiments disclosed herein for supporting a subject's neck and/or head during rest.

Suitably, the neck support member may be in accordance with any one of aspects one to five presented above, or embodiments thereof as disclosed herein.

The neck support members of the present disclosure may be used to support the neck and optionally the head during rest. In embodiments, "rest" refers to short periods of rest, such as rest whilst the patient receives a therapeutic or relaxation treatment. Preferably, "rest" refers to sleep, and even more preferably, long periods of sleep (e.g. hours, such as greater than 3 hours, e.g. up to 12 hours). The use of the support members may typically include engaging a portion of the main pillow body edge, such as to form a neck support pillow as described herein. However, the neck support members can be readily used to provide comfort for supporting the neck by engaging a portion of a surface edge that is not a pillow edge, yet still providing a useful degree of support and comfort to the neck.

In embodiments, said use comprises placing the support members underneath a pillow or surface boost to suitably incline a pillow.

Whilst it will be appreciated herein that the neck support members of the present invention are intended to be used with a main body pillow during rest in a conventional lying position, i.e. on substantially horizontal surface such as a bed or floor, it will be appreciated that the neck support members may also be used alone or in engagement with a pillow in a more upright position.

Suitably, said use of the neck support member comprises releasably engaging the neck support member to a main pillow body, such as a bed pillow, wherein the neck support member extends around an edge of the main pillow body to support the neck in use (for instance as described above for the first to fourth aspects and their embodiments described above). Thus, in embodiments, said use comprises using the neck support member in a method of preparing a neck support pillow as defined herein.

Suitably, said use comprises extending the neck support member around an edge of a main pillow body for supporting the neck in use, the neck support member comprising, a) a neck support body portion having an outer body surface adapted to provide a raised surface relative to a main pillow body surface and having a body thickness suitable for providing support to the neck in use, and b) a cavity within the body portion defining an inner body surface that is adapted to extend around the edge of the main pillow body, thus enabling engagement of the main pillow body edge.

Further Aspects of the Invention

In an aspect of the invention is provided a neck support pillow substantially as described herein in any one of FIGS. 1-4 and 6-9, such as 1 to 8, and optionally, the accompanying description.

In an aspect of the invention is provided a neck support member (i.e. a neck support pillow member) substantially as described herein in any one of FIGS. 1-9, such as 1 to 8, and optionally, the accompanying description.

In an aspect of the invention is provided a method for the manufacture of a neck support member according to any previous aspect or embodiment, the method comprising providing a neck support body core material and forming the neck support body core material into a neck support member as described herein. Suitably, the method comprises forming the core material as a single piece, such as by moulding or sculpting. Alternatively, the method may comprise manufacturing the neck support core as multiple pieces, such as contained in an outer layer. The neck support member may comprise multiple layers of material (e.g. arranged in parallel, such as laminated layers) where each material layer may be identical or different. In this regard, the method may comprise manufacturing a neck support body core having a form as described in relation to any aspect and embodiment herein.

In an aspect of the invention is provided a method of preparing a neck support pillow as described in any of the above aspects and embodiments herein comprising:

a) providing a main pillow body (which may be according to any embodiment described herein above); and b) providing a neck support member according to any aspect and embodiment defined herein above (such as the neck support member of any one of aspects 1-5 or embodiments thereof); and c) disposing the neck support member so as to engage an edge of the main pillow body such that at least a first body portion of the neck support member covers a part of a main pillow face adjacent the edge for supporting the neck in use and a second body portion extending from the first body portion over the main pillow body edge towards the second (opposing) main pillow face, e.g. to substantially encase at least part of an edge of the main pillow body.

In a further aspect is provided a kit of parts comprising a main pillow body and a neck support pillow as described according to any aspect or embodiment disclosed herein. Suitably the main pillow body is a main pillow body as defined according to any one of aspects 1 to 4 and 9 and the neck support member is defined according to any one of aspects 1-5 and 9 and embodiments thereof. Suitably, the main pillow body and neck support member in the kit are configured so as to mutually complement each other, e.g. wherein the main pillow body and neck support are configured to provide a substantially interdependent releasable engagement. The kit may suitably comprise one or more of the main pillow bodies and/or one or more of the neck support members. In embodiments, the kit comprises more than one neck support member. In embodiments comprising more than one neck support member, the neck support members may be identical in structure or different, preferably different. Providing different neck support members in the same package has the advantage of providing the user with a variety of alternatives that can be adapted for different purposes (e.g. general use, orthopaedic use) as described in the background section above. The kit of parts may typically comprise suitable packaging, such as wherein the main pillow body and the neck support member are provided separately but contained within the same package. The kit may suitably comprise instructions describing how to prepare the neck support pillow, such as by releasably engaging the neck support pillow to the main pillow body at its edge. Thus, by providing mutually interdependent neck support member and main body pillow, surprisingly improved neck support and comfort properties may be provided, thus indicating a possible synergy between the product features.

Other Embodiments

In the above aspects and embodiments, the neck support member may be provided with a pillow case (preferably a removable pillow case), which may assist in improving surface ventilation, comfort and allow the surface of the neck support member to be easily cleaned. The pillow case may be tailored to conform substantially to the outer surface profile of the neck support member. In such an embodiment, the neck support member in releasable engagement with the main pillow body may be in direct contact with the pillow case of the main pillow body rather than the main pillow body itself.

Suitably, both the main pillow body and the neck support member may be provided with discrete pillow cases. Alternatively or additionally, in the above aspects and embodiments, the neck support pillow formed by releasably engaging the neck support member to the main pillow body may be provided with a pillow case (preferably a removable pillow case, such as a conventional bed pillow case) covering the main body and the releasable neck support member as a whole. This has the advantage that the neck support member may be disguised for aesthetic purposes, giving the appearance of an integrated pillow, which is not possible using prior art products that include protruding upper back supports or the like that cannot be readily inserted into a conventional bed pillow case.

In embodiments, a tailored pillow case may be provided, having a chamber for insertion of the main pillow body, and a second separate chamber for insertion of the neck support member, i.e. wherein the neck support member still releasably engages the main pillow body, but from within a separate pillow case chamber, i.e. wherein a wall of fabric is provided between the surface of the neck support member and the main pillow body.

The invention also provides the following numbered embodiments 1 to 65:

1. A neck support pillow comprising a main pillow body and a neck support member releasably engaged to the main pillow body, the neck support member comprising:

a first body portion covering at least part of a first face of the main pillow body adjacent an edge of the main pillow body for supporting the neck in use, and a second body portion extending from the first portion over the edge of the main pillow body towards a second face of the main pillow body, the neck support member providing a raised surface relative to the main pillow body surface for supporting the neck in use, the first body portion of the neck support member comprising an elongate body portion extending over the first main pillow body face away from the edge of the main pillow body to cover at least part of the first face of the main pillow body and configured such that at least part of the elongate member extends underneath at least part of the user's head when the user's head and neck is placed on the pillow in use and/or the second body portion of the neck support member comprises an elongate body portion extending over the second main pillow body face away from the edge of the main pillow body to cover at least part of the second face of the main pillow body and configured such that at least part of the elongate member extends underneath at least part of the user's head when the user's head and neck is placed on the pillow in use.

2. A neck support pillow comprising a main pillow body and a neck support member releasably engaged to the main pillow body, the neck support member comprising:

a first body portion covering at least part of a first face of the main pillow body adjacent an edge of the main pillow body for supporting the neck in use, and a second body portion extending from the first portion over the edge of the main pillow body towards a second face of the main pillow body, the neck support member providing a raised surface relative to the main pillow body surface for supporting the neck in use, wherein the parts of the neck support member adjacent the edge of the main pillow body and extending over the edge of the main pillow body that are configured to contact a subject in use have a curved outer surface profile that is substantially convex.

3. A neck support pillow comprising a main pillow body and a neck support member releasably engaged to the main pillow body, the neck support member comprising:

a first body portion covering at least part of a first face of the main pillow body adjacent an edge of the main pillow body for supporting the neck in use, and a second body portion extending from the first portion over the edge of the main pillow body towards a second face of the main pillow body, the neck support member providing a raised surface relative to the main pillow body surface for supporting the neck in use, wherein the outer surface of the second body portion projects in a direction directly away from the main pillow body no more than about 10 cm from the main pillow body edge.

4. A neck support pillow comprising a main pillow body and a neck support member releasably engaged to the main pillow body, the neck support member comprising:

a first body portion covering at least part of a first face of the main pillow body adjacent an edge of the main pillow body for supporting the neck in use, and a second body portion extending from the first portion over the edge of the main pillow body towards a second face of the main pillow body, the neck support member providing a raised surface relative to the main pillow body surface for supporting the neck in use, wherein the neck support member has an outer surface and an inner core, the core consisting essentially of one or more deformable materials.

5. A neck support pillow according to any one of embodiments 2 to 4, wherein the first body portion of the neck support member comprises an elongate body portion extending over the first main pillow body face away from the edge of the main pillow body to cover at least part of the first face of the main pillow body and configured such that at least part of the elongate member extends underneath at least part of the user's head when the user's head and neck is placed on the pillow in use and/or the second body portion of the neck support member comprises an elongate body portion extending over the second main pillow body face away from the edge of the main pillow body to cover at least part of the second face of the main pillow body and configured such that at least part of the elongate member extends underneath at least part of the user's head when the user's head and neck is placed on the pillow in use.

6. A neck support pillow according to any one of embodiments 1 and 3 to 5, wherein the parts of the neck support member adjacent the edge of the main pillow edge and extending over the edge of the main pillow body that are configured to contact a subject in use have a curved outer surface profile that is substantially convex.

7. A neck support pillow according to any one of embodiments 1, 2 and 4 to 6, wherein the outer surface of the second body portion projects in a direction away from the main pillow body no more than about 10 cm from the main pillow body edge.

8. A neck support pillow according to any one of embodiments 1 to 3 and 5 to 7, wherein the neck support member has an outer surface and an inner core, the core comprising, or optionally, consisting essentially of, one or more deformable materials.

9. A neck support pillow according to embodiment 8, wherein the core comprises, or optionally consists essentially of, only one core material, and optionally a solid core material.

10. A neck support pillow according to embodiment 4, 8 or 9, wherein the one or more deformable materials are selected independently from the group consisting of fibres, foam, and latex, optionally selected independently from the group consisting of foam and latex, and optionally wherein the one or more materials are independently selected from foam, optionally wherein the foam is memory foam.

11. A neck support pillow according to any previous embodiment, wherein the neck support member substantially encases at least part of the length of an edge of the main pillow body.

12. A neck support pillow according to any previous embodiment wherein the second body portion extends from the first body portion over the edge of the main pillow body to cover at least part of a second face of the main pillow body adjacent the pillow edge, optionally wherein the second body portion extends over the second pillow face so as to be disposed to be trapped between the second face of the pillow and the surface on which the pillow is placed in use.

13. A neck support pillow according to embodiment 12 wherein at least a part of the second body portion that extends over at least a part of the second pillow face has a substantially flat outer surface profile useable to contact the surface on which the pillow is placed in use, and optionally wherein the parts of the neck support member adjacent the edge of the main pillow body and extending over the edge of the main pillow body that are configured to contact a subject in use have a curved outer surface profile that is substantially convex.

14. A neck support pillow according to any previous embodiment, wherein the thickness of the neck support member is substantially uniform throughout.

15. A neck support pillow according to any one of embodiments 1 to 13, wherein the thickness of the neck support member is not substantially uniform throughout.

16. A neck support pillow according to embodiment 15, wherein the maximum thickness of the first body portion is greater than the maximum thickness of the second body portion.

17. A neck support pillow according to any one of embodiments 1 to 16, wherein the first and second body portions are substantially the same length and/or thickness.

18. A neck support pillow according to any one of embodiments 1 and 5 to 17 wherein only one of the first and second body portions comprises an elongate body portion.

19. A neck support pillow according to any previous embodiment, wherein the first body portion comprises an elongate body portion or the second body portion comprises an elongate body portion.

20. A neck support pillow according to embodiment 19 wherein the elongate body portion is substantially the same thickness at its terminal edge as the part that covers the part of the main pillow body face adjacent the pillow edge.

21. A neck support pillow according to embodiment 19 wherein the part of the neck support body portion that covers the part of the main pillow body face adjacent the pillow edge has a maximum thickness greater than that of the elongate body portion extending away from the part of the neck support member adjacent the edge.

22. A neck support pillow according to any previous embodiment wherein a neck support member body portion extends over the main pillow body surface away from the pillow edge such that the distance from the pillow edge to the terminal end of the neck support body portion farthest from the pillow edge is at least 10 cm, and optionally no more than 70 cm.

23. A neck support pillow according to any one of embodiments 1 and 5 to 22 wherein the elongate portion does not extend over the edge of the main pillow body opposite the edge over which the second body portion extends from the first body portion.

24. A neck support pillow according to any previous embodiment wherein the outer surface of the second body portion projects in a direction directly away from the main pillow body no more than about 8 cm from the main pillow body edge, optionally no more than about 6 cm, or optionally no more than about 4 cm.

25. A neck support pillow according to any previous embodiment wherein the thickness of the neck support member at the terminal end of the first and/or second body portion is tapered toward the main pillow body surface, optionally wherein the terminal end of the first body portion is tapered toward the main pillow body surface, optionally wherein both the terminal ends of the first and second body portions are tapered toward the main pillow surface.

26. A neck support pillow according to any previous embodiment wherein the neck support member is provided such that the resting configuration of the neck support member when not in engagement with the main pillow body is in a form substantially ready for engagement with the main pillow body edge.

27. A neck support pillow according to any previous embodiment wherein the core of the neck support member is formed of a single piece of material.

28. A neck support pillow as described in any previous embodiment wherein the inner surface of the neck support member disposed to contact the main pillow body surface has a substantially "r"-, "V"- or "U"-shaped cross section, optionally a substantially "U"-shaped cross section.

29. A neck support pillow as described in any previous embodiment wherein the neck support member substantially encases at least half of the entire length of the pillow edge, such as at least two thirds of the entire length of the pillow edge, optionally wherein the neck support member encases substantially the entire length of the main pillow edge.

30. A neck support pillow as described in any previous embodiment wherein the main pillow body has a central body portion that is substantially the same thickness, or thicker, than one or more portions of the main pillow body adjacent the pillow edges when the main pillow body is in a resting state, optionally wherein the pillow is a bed pillow.

31. A neck support member as defined in any previous embodiment.

32. A neck support member for use in supporting the neck, the neck support member configured so as to be releasably engageable with an edge of a main pillow body, the neck support member having a first body portion and a second body portion extending from an end of the first body portion, the first body portion configured so as to be useable to cover at least part of a first face of a main pillow body adjacent an edge of the main pillow body; and the second body portion disposed relative to the first body portion so as to be useable to extend over the edge of the main pillow body from the first body portion toward the second pillow face, wherein the first and second body portions, when disposed as such in use, provide a raised surface relative to the main pillow body surface for supporting the neck; wherein the first body portion of the neck support member comprises an elongate body portion configured relative to the first and second body portions so as to be useable, when the neck support member is engaged to a main pillow edge, to extend over a face of the main pillow body to cover at least part of a first face of the main pillow body adjacent the pillow edge and configured so as to be useable such that at least part of the elongate member extends underneath at least part of the user's head when the user's head and neck is placed on the pillow in use, and/or wherein the second body portion of the neck support member comprises an elongate body portion configured relative to the first and second body portions so as to be useable, when the neck support member is engaged to a main pillow edge, to extend over a face of the main pillow body adjacent the pillow edge to cover at least part of a second a face of the main pillow body and configured so as to be useable such that at least part of the elongate member extends underneath at least part of the user's head when the user's head and neck is placed on the pillow in use.

33. A neck support member for use in supporting the neck, the neck support member configured so as to be releasably engageable with an edge of a main pillow body, the neck support member having a first body portion and a second body portion extending from an end of the first body portion, the first body portion configured so as to be useable to cover at least part of a first face of a main pillow body adjacent an edge of the main pillow body; and the second body portion disposed relative to the first body portion so as to be useable to extend over the edge of the main pillow body from the first body portion toward the second pillow face, wherein the first and second body portions, when disposed as such in use, provide a raised surface relative to the main pillow body surface for supporting the neck; wherein the parts of the neck support member that are configured so as to a) be disposed to cover a part of a first face of the main pillow body adjacent the edge of the main pillow body; and b) extend over the edge of the main pillow body toward the second face when the neck support pillow is engaged to a main pillow edge, have a curved outer surface profile that is substantially convex so as to be useable to contact the user's neck when the neck pillow body is engaged to a main pillow body edge and the user's head and neck is placed on the pillow in use.

34. A neck support member for use in supporting the neck, the neck support member configured so as to be releasably engageable with an edge of a main pillow body, the neck support member having a first body portion and a second body portion extending from an end of the first body portion, the first body portion configured so as to be useable to cover at least part of a first face of a main pillow body adjacent an edge of the main pillow body; and the second body portion disposed relative to the first body portion so as to be useable to extend over the edge of the main pillow body from the first body portion toward the second pillow face, wherein the first and second body portions, when disposed as such in use, provide a raised surface relative to the main pillow body surface for supporting the neck; wherein the outer surface of the second body portion is configured such that when the neck support member is in engagement with a main pillow body edge in use, the outer surface of the second body portion projects in a direction directly away from the main pillow body no more than about 10 cm from the main pillow body edge.

35. A neck support member for use in supporting the neck, the neck support member configured so as to be releasably engageable with an edge of a main pillow body, the neck support member having a first body portion and a second body portion extending from an end of the first body portion, the first body portion configured so as to be useable to cover at least part of a first face of a main pillow body adjacent an edge of the main pillow body; and the second body portion disposed relative to the first body portion so as to be useable to extend over the edge of the main pillow body from the first body portion toward the second pillow face, wherein the first and second body portions, when disposed as such in use, provide a raised surface relative to the main pillow body surface for supporting the neck; wherein the neck support member has an outer surface and an inner core, the core consisting essentially of one or more deformable materials.

36. A neck support member according to any one of embodiments 33 to 35, wherein the first body portion of the neck support member comprises an elongate body portion configured relative to the first and second body portions so as to be useable, when the neck support member is engaged to a main pillow edge, to extend over a face of the main pillow body to cover at least part of a first face of the main pillow body adjacent the pillow edge and configured so as to be useable such that at least part of the elongate member extends underneath at least part of the user's head when the user's head and neck is placed on the pillow in use, and/or wherein the second body portion of the neck support member comprises an elongate body portion configured relative to the first and second body portions so as to be useable, when the neck support member is engaged to a main pillow edge, to extend over a face of the main pillow body to cover at least part of a second a face of the main pillow body adjacent the pillow edge and configured so as to be useable such that at least part of the elongate member extends underneath at least part of the user's head when the user's head and neck is placed on the pillow in use.

37. A neck support member according to any one of embodiments 32 and 34 to 36, wherein the parts of the neck support member that are configured so as to a) be disposed to cover a part of a first face of the main pillow body adjacent the edge of the main pillow body; and b) extend over the edge of the main pillow body toward the second face when the neck support pillow is engaged to a main pillow edge, have a curved outer surface profile that is substantially convex so as to be useable to contact the user's neck when the neck pillow body is engaged to a main pillow body edge.

38. A neck support member according to any one of embodiments 32, 33 and 35 to 37, wherein the outer surface of the second body portion is configured such that when the neck support member is in engagement with a main pillow body edge in use, the outer surface of the second body portion projects in a direction directly away from the main pillow body no more than about 10 cm from the main pillow body edge.

39. A neck support member according to any one of embodiments 32 to 34 and 36 to 38, wherein the neck support member has an outer surface and an inner core, the core comprising, or optionally, consisting essentially of, one or more deformable materials.

40. A neck support member according to embodiment 39, wherein the core comprises, or optionally consists essentially of, only one core material, and optionally a solid core material.

41. A neck support member according to embodiment 35, 39 or 40, wherein the one or more deformable materials are selected independently from the group consisting of fibres, foam, and latex, optionally selected from the group consisting of foam and latex, and optionally wherein the one or more materials are independently selected from foam, optionally wherein the foam is memory foam.

42. A neck support member according to any one of embodiments 32-41, wherein the neck support member is useable so as to substantially encase at least part of the length of an edge of the main pillow body for supporting a user's neck.

43. A neck support member according to any one of embodiments 32-42 wherein the second body portion is configured such that it is useable to extend from the first body portion over the edge of the main pillow body to cover at least part of a second face of the main pillow body adjacent the pillow edge, optionally wherein the second body portion is configured to extend over the second pillow face to an extent so as to be useable to be trapped between the second face of the pillow and the surface on which the pillow is placed in use.

44. A neck support member according to embodiment 43 wherein at least a part of the second body portion that is configured so as to be useable to extend over at least a part of the second pillow face has a substantially flat outer surface profile useable to contact the surface on which the pillow is placed in use, and optionally wherein the parts of the neck support member disposed so as to be adjacent the edge of the main pillow body and extend over the edge of the main pillow body such that they are configured to contact a subject in use, have a curved outer surface profile that is substantially convex.

45. A neck support member according to any of embodiments 32-44, wherein the thickness of the neck support member is substantially uniform throughout.

46. A neck support member according to any one of embodiments 32 to 45, wherein the thickness of the neck support member is not substantially uniform throughout.

47. A neck support member according to embodiment 46, wherein the maximum thickness of the first body portion is greater than the maximum thickness of the second body portion.

48. A neck support member according to any one of embodiments 32 to 47, wherein the first and second body portions are configured so as to be of substantially the same length and/or thickness when engaging the pillow edge in use.

49. A neck support member according to any of embodiments 32 and 36 to 48 wherein only one of the first and second body portions comprises an elongate body portion.

50. A neck support member according to any one of embodiments 32 to 49 wherein the first body portion comprises an elongate body portion, or the second body portion comprises an elongate body portion.

51. A neck support member according to embodiment 50 wherein the elongate body portion is substantially the same thickness at its terminal edge as the part of the neck support body portion that is useable to cover the part of the main pillow body face adjacent the pillow edge when the neck support pillow is releasably engaged to the pillow edge in use.

52. A neck support member according to embodiment 50 wherein the part of the neck support body portion that is configured so as to be useable to cover the part of the main pillow body face adjacent the pillow edge when the neck support member is in engagement with a pillow edge in use has a maximum thickness greater than the elongate body portion extending away from said neck support body portion.

53. A neck support member according to any one of embodiments 32 and 36 to 52 wherein the elongate body portion is configured such that when the neck support member is engaged to the pillow edge, the elongate body portion causes the body portion to extend over the main pillow body surface away from the pillow edge by at least 10 cm, and optionally no more than 70 cm.

54. A neck support member according to any one of embodiments 34 and 36-53 wherein the thickness of the part of the second body portion that is useable to project in a direction directly away from the main pillow body when engaged on the pillow in use is no more than about 8 cm, optionally no more than 6 cm, or optionally no more than 4 cm.

55. A neck support member according to any one of embodiments 32-54 wherein the thickness of the neck support member at the terminal end of the first and/or second body portions is tapered toward the ends, optionally where the terminal end of the first body portion is tapered toward the end, optionally wherein both the terminal ends of the first and second body portions are tapered toward the end.

56. A neck support member according to any one of embodiments 32-55 wherein the resting configuration of the neck support member when not in engagement with a main pillow body is in a form substantially ready for engagement with the pillow body.

57. A neck support member according to any one of embodiments 32-56 wherein the core of the neck support member is formed of a single piece of material.

58. A neck support member according to any one of embodiments 32-57 wherein the neck support member is configured such that the first and second body portions represent first and second jaw members having an open mouth end a closed end, the jaw members defining side walls of an inner recess, the recess being useable so as to receive a pillow edge and the first and second jaw members are useable to releasably engage a pillow edge in use.

59. A neck support member as described in any previous embodiment wherein the inner recess surface profile of the neck support member configured to engage a main pillow body surface has a substantially "r"-, "V"- or "U"-shaped surface profile, preferably a "U"-shaped surface profile.

60. A method of preparing a neck support pillow comprising:

a) providing a main pillow body;

b) providing a neck support member as defined according to any previous embodiment; and c) disposing the neck support member along an edge of the main pillow body such that at least a first body portion of the neck support member covers a part of the main pillow surface adjacent the main pillow body edge and the second body portion extends from the first body portion over the edge of the main pillow body toward the second face of the main pillow body to engage the main pillow body, optionally wherein the neck support pillow is according to any of embodiments 1 to 30.

61. A method for the manufacture of a neck support member, wherein the neck support member is as defined in any previous embodiment, optionally any one of embodiments 31 to 59, the method comprising providing a neck support body filler material and forming the neck support body filler material into a neck support member as described herein.

62. A neck support pillow substantially as described herein in any one of FIGS. 1-4, 6, 7 and 9, and optionally as further described herein by the accompanying description.

63. A neck support member substantially as described herein in any one of FIGS. 1-9 and optionally as further described herein by the accompanying description.

64. Use of a neck support member as described in any previous embodiment for supporting a subject's neck in a resting position, optionally wherein the use is for supporting a subject's neck during sleep.

65. The use according to embodiment 64 wherein the use comprises releasably engaging the neck support member to a main pillow body, optionally a bed pillow, wherein the neck support member extends over an edge of the main pillow body to support the neck in use.

General

Other General Comments

By reference to "raised surface relative to the main pillow body surface" it is meant that the neck support member presents a raised surface relative to the part of the main pillow surface that directly beneath the neck support member in use. Put another way, this does not necessarily mean that the outer surface of the neck support member that is useable to contact a user's neck need be the uppermost, i.e.

highest part of the neck support pillow when the pillow is placed on a surface, only that the part of the neck support member that is to be directly beneath the user's neck provides a surface that is raised (e.g. in a plane perpendicular to the pillow face surface face) relative to the part of the main pillow surface that is beneath the user's neck and the neck support member.

Where references are made herein to a neck support member or a neck support pillow being used or usable by a user, or being in use, these references typically refer to a typical human adult of average proportions, i.e. with a head and neck that are of average proportions.

The skilled artisan will be familiar with and be able to identify a pillow "edge" for a given pillow. Typically, a pillow edge is a part of the pillow at which two pillow faces are adjoined. For pillows that have a thicker edge portion, such as where the edge is substantially vertical (such that the pillow faces do not gradually tend to a specific spatial point at which two faces meet), the pillow edge may suitably be the region of the pillow that in practice adjoins the two pillow faces rather than a specific finite spatial point.

Except where it is explicitly stated to the contrary, where a disclosure herein is described as "comprising" a feature or features, the term comprising includes embodiments that "consist essentially of", as well as embodiments that "consist of" the relevant feature or features. In other words, the term "comprising" provided herein may be suitably replaced by the term "consisting essentially of" and "consisting of". Suitably, embodiments of the present disclosure may "consist essentially of" the relevant feature or features. In embodiments, the embodiments of the present disclosure "consist of" the relevant feature or features. Likewise, except where it is explicitly stated to the contrary, where a disclosure herein is described as "consist essentially of" certain feature(s), this includes embodiments that "consist of" the relevant feature or features. In other words, the term "consisting essentially of" as used herein may be replaced by the term "consisting of".

References herein to a "user" or a "subject" are equivalent and interchangeable.

The following passages describe exemplary embodiments of the neck support pillows and neck support members according to the present disclosure with reference to the figures. Whilst certain the figures show particular combinations of features, the skilled person will appreciate in view of the disclosure herein that particular features of the respective neck support members and/or pillows are respectively interchangeable.

Exemplary neck support pillows of the invention are depicted in FIGS. 1-4 and 6-9. Neck support members according to the invention are depicted in FIGS. 1-9, wherein FIGS. 1A, 2A, 3A and 5 depict cross-section or end-on views of neck support members of the present invention independent of a main pillow body, i.e. configured so as to be engageable with a main pillow body.

FIG. 1C depicts a perspective view of an exemplary embodiment of a neck support pillow 10 according to the present disclosure. FIG. 1B depicts a cross sectional (or side) view of the same neck support pillow. FIG. 1A depicts a neck support member for supporting the neck that is releasably engageable with a main pillow body, such as a main pillow body described in FIGS. 1B and 1C.

The neck support pillow comprises a neck support member 20 releasably engaged to a main pillow body 30, i.e. wherein the main pillow body edge 34 or first edge and regions 33 adjacent the edge are received within the recess 40 of the neck support member. The main pillow body has a first, i.e. upper, face 31 or first face which is illustrated in a form so as to be disposed towards a user, a second, opposing, i.e. bottom, face 32 or second face, disposed so as to contact the surface on which the pillow is placed in use, and a second edge 34A.

The neck support member comprises a first body portion 21, which comprises an elongate body portion 23 or first elongate body portion extending over substantially the entire first face 31 of the main pillow 30 from a first terminal end 23A, 25 to a first connection end 23B opposite the first terminal end. The portion of the first body portion covering the part or region 33 of the first face of the main pillow body adjacent the pillow edge 34 or first edge (i.e. the edge portion of the first body portion) is thicker (see dimension "t" in FIG. 1B) than the portion of the elongate member 23 distal from the pillow edge 34, e.g. at its terminal ends. The main pillow body in the embodiment shown is a bed pillow wherein the central body portion of the main pillow 30 is thicker than the main pillow body portions adjacent the first edge 34, i.e. in the regions 33 of main pillow body portion. The elongate portion is thus configured to extend beneath the entirety of a user's head when a user's neck is supported at the edge of the pillow and the user's head is placed on the first pillow face.

A second body portion 22, being comprised of a second elongate body portion 26 with a second terminal end 26A, 25 and a second connection end 26B opposite the second terminal end, extends from the first connection end of the first portion 21 over the first edge 34 of the main pillow body towards a second face 32 of the main pillow body 30 with the second connection end adjacent to the first connection end at a connection region 34B. The second elongate body portion 26 can extend over at least the region 33 corresponding to the second face 32. Thus, the neck support member entirely encases, i.e. wraps around the pillow edge forming a releasable engagement with the main pillow body. Whilst FIG. 1C depicts a seamless interaction between the main pillow body and neck support member, the skilled person will appreciate that, in practice. The first body portion is substantially thicker than the second body portion in the region at the first connection end and adjacent the first edge (see dimension "t"). In the embodiment shown, the first body portion 21 extends over the first face of the pillow 31 a greater extent than the second body portion 22 extends over the second face 32 of the main pillow body 30. This provides adequate additional support for the neck and additional comfort and support for the head, whilst allowing the main pillow body to largely exhibit its usual structural properties (e.g. deformability).

The neck support member 20 extends along the entire length of the main pillow edge 34 (see dimension "l" in FIG. 2C) and thus the neck support member completely encases the entire edge 34 of the main pillow.

The neck support member provides a raised surface relative to the main pillow body surface for supporting the neck in use, as depicted by thickness "t" in FIG. 1B. In the depicted embodiment, the raised surface at the region adjacent the pillow edge is in fact the highest, i.e. the uppermost, surface of the pillow relative to the user. However, this need not be the case and embodiments of the invention may include embodiments wherein the part of the pillow adjacent the edge is not the highest surface. Such embodiments would still provide support for the user's neck to bias it toward a neutral position, provided the main pillow body 30 were adequately deformed by the weight of the head in use. By providing a thicker body (i.e. a relatively more raised surface) in the region disposed to support the user's neck (i.e. the region adjacent 33 the pillow edge 34, see dimension "t" in FIG. 1B), the raised surface may protrude into the cavity between the user's shoulder and neck (see, e.g. FIG. 8B), thus supporting the neck in a more neutral position relative to the usual orientation of the spine, whereas the thinner elongate body portion 23 has a substantially uniform thickness extending over the first pillow face 31 to provide additional comfort and support for the head, but allowing the head to rest in a natural and neutral position relative to the neck.

The parts of the neck support member 20 adjacent the edge of the main pillow body (i.e. region 33 of the first face 31) and extending over the edge 34 of the main pillow body that are configured to contact a subject in use, i.e. body portions 21 and 22 in the region of the edge, have a curved outer surface profile that is substantially convex (i.e. outwardly curved toward the user). In other words, those parts that are presented to the user's shoulder and neck in use (see portions 21 and 22 of FIGS. 8A and 8B) are substantially convex. The curvature is a plane perpendicular to the surface on which the pillow is placed for use, i.e. perpendicular to the bottom face 32. The part of the second body portion 22 that extends over the face of the opposing pillow edge 32 is depicted as having a flat outer surface profile. This may be formed as such, or may become flattened in use due to the weight of the user's head and neck compressing the body filler material.

The respective features of the neck support member depicted in FIG. 1A are as described above in respect of the neck support member. Said first and second body portions 21 and 22 may thus be considered to be first 21 and second 22 jaw members that define a cavity/recess 40 that is capable of receiving and releasably engaging a main pillow body. The cavity provides the neck support member with a U-shaped inner surface profile. The neck support member is shown in a configuration ready for engagement with a pillow edge. In this embodiment, the neck support member is formed in a manner such that the neck support member, in its resting position, adopts substantially the configuration shown, such as by use of a pillow case that forces the neck support member into such a position. However, the present invention contemplates embodiments that may be forced, e.g. curved/folded/moulded by the user into such a configuration. The neck support member body core consists of memory foam, but any suitable core filler material(s) described herein may alternatively be used.

FIG. 2C depicts a perspective view of an alternative embodiment of the neck support pillow 10 of the present disclosure. FIG. 2B depicts a cross sectional (or side) view of the same neck support pillow. FIG. 3A depicts a neck support member for supporting the neck that is releasably engageable with a main pillow body. Unlike the neck support pillow of FIGS. 1B and 1C, the first body portion 21 and second body portion 22 extend over the respective first 31 and second 32 main pillow faces less than half the width of the pillow (see dimension "w" in FIG. 2C). Thus, unlike the FIG. 1 embodiment, the neck support member of FIG. 2 does not comprise first 21 or second 22 body portions that extend over the first 31 and/or second 32 pillow face so as to extend underneath the head of the user when the user's neck is supported at the edge portion and the head is placed on the pillow. However, desirable restriction of lateral movement of the neck support member 20 relative to the pillow 30 during sleep is nevertheless provided by way of the releasable engagement and the added pressure of the neck in use. The neck support member 20 again curves toward the user's head and shoulder and has a body thickness (see dimension "t" in FIG. 2A) so as to project in a direction directly away from the main pillow body in a horizontal direction (i.e. direct shown by "t" in FIG. 2A or 8A) toward the user whilst enabling the user to place their shoulder on the base surface and still place their head on the pillow face (see, e.g. illustration of use in FIG. 8A). In this embodiment, the thickness of the body portion means that the neck support member projects towards the user in a horizontal direction around 2-4 cm, preferably 3 cm.

Figure 3B:
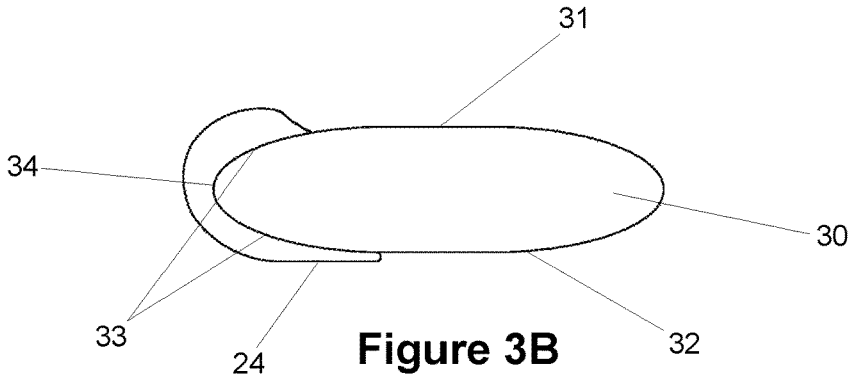
Figure 3C:
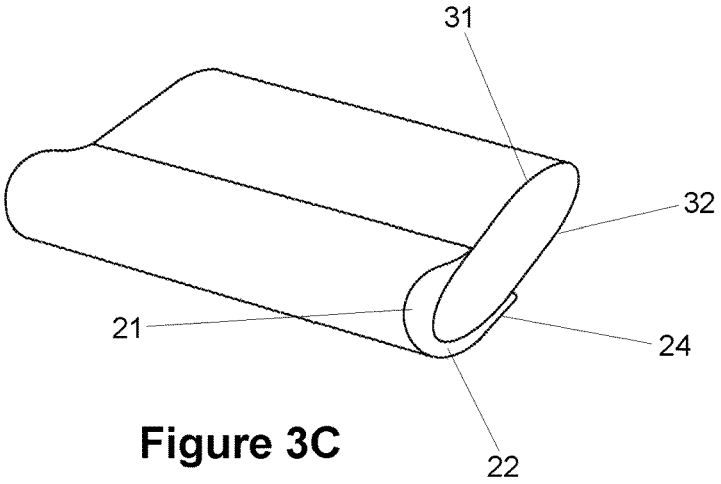
Figure 8A:
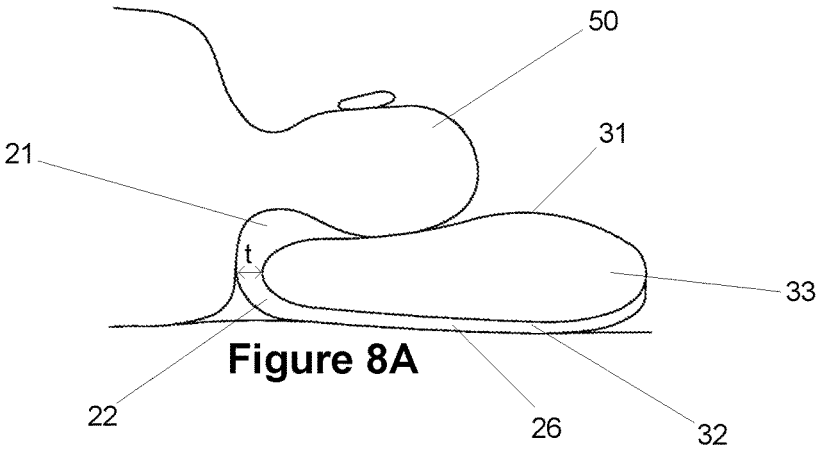
FIG. 8 depicts in A), B) and C) exemplary uses of the same neck support pillow body showing the versatility of the product and the beneficial effects on neck support that can be provided in the various positions.

FIG. 3 depicts an embodiment of a type of neck support member 20 that has a portion (i.e. first body portion 21) which extends over the width of the first face of the main pillow body 31 to a lesser extent than the portion of the neck support member (i.e. the second body portion 22) extends over the second opposing face 32 of the main pillow 30. The first body portion 21 adjacent the edge 34 (i.e. in the region 33) is thicker than the second body portion in the region at the edge 34 or adjacent the edge 33 on the second face 32 of the main pillow body to enable adequate support for the neck. It has been found that a longer second body portion 22 functions as an effective anchor trapped underneath the pillow 30, made more effective when the user's head is placed on the pillow, as depicted in FIG. 8A.

Figure 4A:
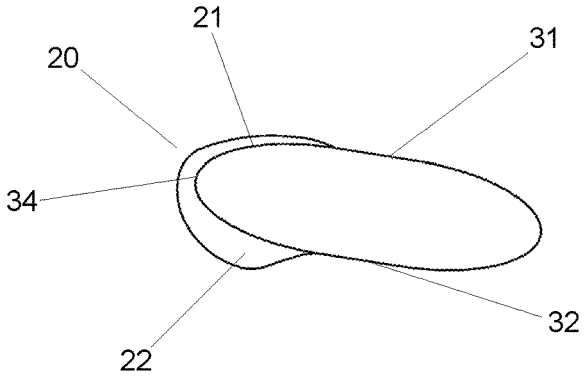
FIG. 4 depicts in A) a cross section/side view of a neck support pillow of the invention wherein the thickness of a first body portion/jaw member at the part of the main pillow face adjacent the edge is greater than the second body portion (or vice versa) but wherein the thicker part is disposed in use to contact the surface on which the pillow is placed (thus raising the pillow edge); in B) is shown the same pillow flipped upside down to show the thicker portion disposed so as to contact the user's neck in use. The pillow is in a more conventional configuration and the neck support protrudes upwards from the main pillow surface to the curvature of the neck.
Figure 4B:
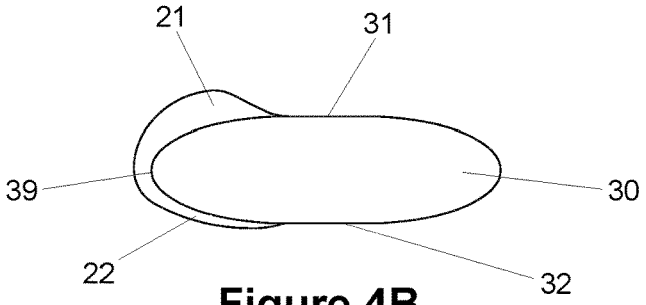

FIGS. 4A and 4B depict the same neck support pillow 10 flipped upside down, exemplifying the versatility of the pillow. Thus, the neck support member 20 may be positioned such that the thicker portion is placed underneath the pillow (i.e. as shown in 4A) or wherein the thicker portion is placed on the pillow top face disposed to face the user (as in FIG. 4B).

FIG. 5 shows a cross-sectional view of an embodiment of a neck support member 20 having a U-shaped inner recess surface profile 40, a curved outer surface profile, and wherein both terminal ends 25 of the neck support member (i.e. the terminal ends of the first 21 and second 22 body/jaw portions) are tapered in thickness. This thus allows for a smoother, more comfortable contact with the head and neck and a more integrated look and feel when the neck support member is releasably engaged to a main pillow edge.

Figure 6A:
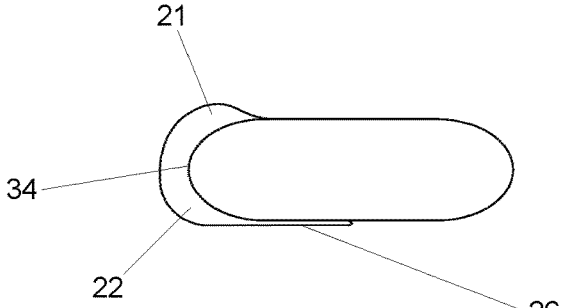
FIG. 6 depicts in A) and B) the different exemplary thicknesses that may be provided at the second pillow face disposed so as to be trapped between the second pillow face and the base surface.
Figure 6B:
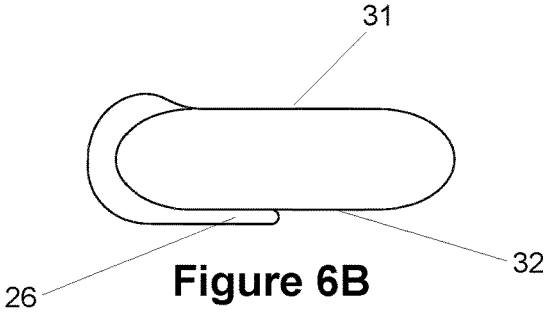

FIGS. 6A and 6B depict analogous neck support pillows 10 of the present disclosure that differ from each other solely in respect of the thickness of the portion of the neck support member (i.e. the second body portion 22) that extends over the second pillow face 32 underneath the pillow. The neck support member of these embodiments has a second body portion 22 comprising elongate body portion 26 that extends from the edge 34 over around half of the width of the pillow face 32 so as to extend underneath part of the user's head when a user's neck is supported at the pillow edge and the user's head is placed on upper pillow surface 31.

Figure 7A:
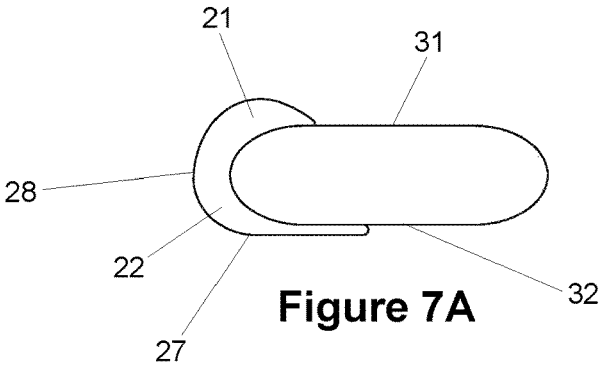
FIG. 7 depicts in A) and B) the effect of different gradient of curvature of the second body portion on the base part. A smaller gradient as shown in 7B can mean that the outer surface profile of the part of the second body portion contacting the surface is flat and wherein the flat base may project beyond the main pillow body to provide a stable base.
Figure 7B:
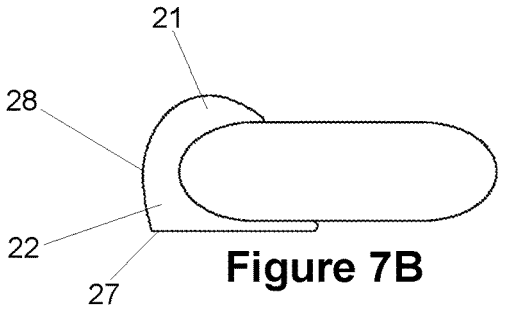

FIGS. 7A and 7B depict analogous neck support pillows 10 according to the present disclosure that differ in respect of the gradient of curvature of the parts of the first 21 and second 22 body portions that are disposed to contact the user. Both are thus embodiments in accordance with the second aspect disclosed herein. However, the flat outer surface profile of the second body portion that is not disposed to contact the user (i.e. the part disposed to contact the base surface on which the pillow is placed) differs between the two embodiments in that the embodiment of FIG. 7A depicts a flat outer surface profile in the region underneath the second face 32, and the embodiment in FIG. 7B shows a flat outer body portion that extends beyond the edge 34 of the pillow 30 toward the user to provide a more stable base. Nonetheless, the parts of the first 21 and second 22 body portions disposed to the user have a curved outer surface profile.

Figure 8B:
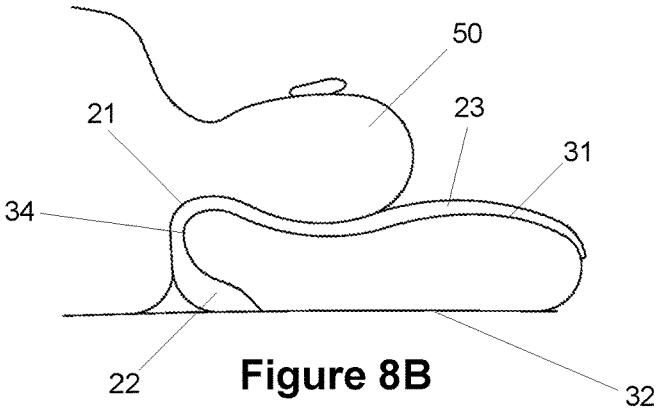
Figure 8C:
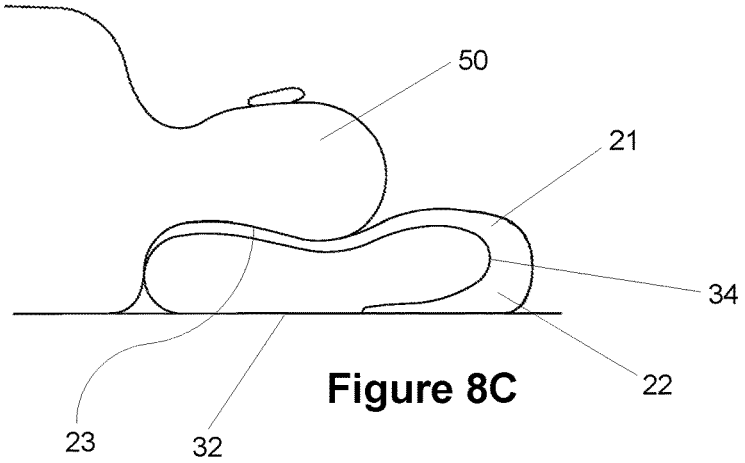

FIG. 8 depicts in A), B) and C) exemplary alternative uses of the same neck support pillow of the present disclosure. The drawings depict the user's head 50 placed on the pillow in use. FIGS. 8A and 8B show the user utilising the neck support feature of the present invention, whereas FIG. 8C shows a user opting not to use the neck support feature, but still benefiting from the additional comfort and support provided to the head by the elongate portion. Where the present application refers to use of the pillows in the context of the invention, this is suitably intended to refer to wherein the user is utilising the neck support function provided by the first and second neck support member body portions, i.e. placing their neck at the edge engaged by the first and second body portions and placing their head on the upper pillow face.

Referring to FIG. 8A, the neck support pillow comprises a neck support member 20 releasably engaged to a main pillow body 30. The main pillow body has a first, i.e. upper, face 31 disposed towards a user, and a second, opposing, i.e. bottom, face 32 disposed so as to contact the base surface on which the pillow is placed. Referring to FIG. 8A, the neck support member comprises a first body portion 21, and a second body portion 22, which comprises an elongate body portion 26 extending over substantially the entire second face 32 of the main pillow 30. The part of the first body portion 21 adjacent the pillow edge 34 (i.e. the edge portion of the first body portion) has a maximum thickness greater than the second body portion 22. The thickness of the second body portion 22 is largely uniform such that the thickness of the elongate body portion 26 distal from the pillow edge 34 is substantially the same as the thickness of the part of the second body portion adjacent pillow edge 34. The elongate body portion is thus configured to extend beneath the entirety of a user's head when a user's neck is supported at the edge 34 of the pillow and the user's head 50 is placed on the first pillow face 31. The neck support member projects towards the user (see "t" in FIG. 8A) by around 3 cm.

FIG. 8B shows the same neck support pillow flipped upside down relative to the user. For illustrative purposes, the feature numbering has remained. Thus, FIG. 8B depicts an embodiment wherein the users head is placed on pillow face 31, wherein second body portion 22 is thicker than the first body portion 21, and wherein the first body portion comprises an elongate body portion 23 that extends over substantially the entire width of first pillow face 31 directly beneath the head. Analogously to FIG. 8A, the thickness of the first body portion 21 is largely uniform such that the thickness of the elongate body portion 23 distal from the pillow edge 34 is substantially the same as the thickness of the part of the first body portion 21 adjacent pillow edge 34. The elongate body portion is thus configured to extend directly beneath the entirety of a user's head when a user's neck is supported at the edge 34 of the pillow and the user's head 50 is placed on the first pillow face 31.

FIG. 9A depicts a cross section/side view of a neck support pillow of the invention wherein the second body portion of the neck support member extends from the first body portion/jaw member over the pillow edge towards the second pillow face, but not to an extent so as to extend over the second pillow face and under the pillow. The entire outer surface profile of the neck support member configured to contact the user's head and neck in use has a substantially convex outer surface profile. FIG. 9B depicts a cross section/side view of a neck support pillow of the invention wherein the second body portion/jaw member of the neck support member extends from the first body portion over the pillow edge towards the second pillow face, but not to an extent so as to extend over the second pillow face and under the pillow. The part of the neck support member configured to contact the base surface in FIG. 9B has a flat outer surface profile.

Both embodiments in FIGS. 9A and 9B have an inner surface profile that is substantially "r" shaped for contacting the main pillow body, but the outer surface profile of each embodiment differs. This "r" shape still provides adequate engagement of the pillow and restricts movement of the neck support member relative to the main pillow in use. The inventor has also surprisingly found that the second body portion in such embodiments tends to be forced under the pillow edge to cover part of the second face 32 adjacent the pillow edge 34 during use by the pressure of the head and neck and the force of the user's shoulder, thus providing an improved engagement and surprisingly restricted movement during use.

The embodiments described above are intended to provide illustrative examples of the invention and features of the invention. Modifications, variations and equivalents to elements of the above, such as would be readily apparent to the skilled user, are encompassed within the spirit and scope of the invention and as defined by the claims.

I claim:

1. A neck support member being releasably engageable to a main pillow body having a first face with a first edge and a second edge opposite said first edge, and a second face opposite said first face, said neck support member comprising:

a first body portion being comprised of a first elongate body portion with a first terminal end and a first connection end opposite said first terminal end so as to cover said first edge and a first region of said first face of said main pillow body adjacent to said first edge, said first elongate body portion having a first thickest portion between said first terminal end and said first connection end and adjacent to said first connection end; and a second body portion being comprised of a second elongate body portion with a second terminal end and a second connection end opposite said second terminal end and extending from said first connection end of said first elongate body portion so as to extend over said first edge and a second region of said second face of of said main pillow body adjacent to said first edge, and so as to form a raised surface with said first elongate body portion relative to said first face and said second face, wherein said first connection end of said first elongate body portion connects to said second connection end of said second elongate body at a connection region so as to align said connection region with said first edge, said thickest portion being adjacent said connection region.

2. The neck support member, according to claim 1, wherein said first body portion and said second body portion form a curved outer surface profile so as to be convex relative to said main body pillow.

3. The neck support member, according to claim 1, wherein said second body portion has a set configuration and a pressed configuration, and wherein an outer surface of said second body portion in said pressed configuration projects in a direction less than 10 cm from said set configuration.

4. The neck support member, according to claim 1, wherein said first body portion is comprised of one or more deformable materials selected from a first group consisting of fibers, foam, and latex, and wherein said second body portion is comprised of one or more deformable materials selected from a second group consisting of fibers, foam, and latex.

5. The neck support member, according to claim 1, wherein said first connection end of said first elongate body portion connects to said second connection end of said second elongate body at a connection region so as to encase at least part of a length of said first edge of said main pillow body.

6. The neck support member, according to claim 1, wherein said second terminal end of said second elongate extends from said second connection end at said connection point so as to cover at least part of said second region.

7. The neck support member, according to claim 6, wherein at least a part of said second elongate body has a flat outer surface profile.

8. The neck support member, according to claim 1, wherein said second elongate body portion has a second thickest portion between said second terminal end and said second connection end and adjacent to said second connection end, and wherein said first thickest portion is greater than said second thickest portion.

9. The neck support member, according to claim 1, wherein wherein a thickness at said connection point is greater than a thickness at said first terminal end of said first elongate body and greater than a thickness at said second terminal end of said second elongate body.

10. The neck support member, according to claim 1, wherein said first elongate body portion has an initial configuration and an extended configuration, and wherein said first terminal ends extends in a direction more than 10 cm from said initial configuration.

11. The neck support member, according to claim 1, wherein said second elongate body portion has a second thickest portion between said second terminal end and said second connection end and adjacent to said second connection end, and wherein said second thickest portion has an original configuration and a modified configuration, said second thickest portion in said modified configuration projecting in a direction less than 8 cm from said original configuration.

12. The neck support member, according to claim 1, wherein said first elongate body portion is tapered from said first thickest portion to said first terminal end.

13. The neck support member, according to claim 1, wherein said first elongate body portion is made integral with said second elongate body portion.

14. The neck support member, according to claim 1, wherein said first elongate body portion is a first jaw member, wherein said second elongate body portion is a second jaw member so as to form side walls of an inner recess, and wherein said inner recess has an opened mouth end and a closed mouth end so as to to releasably engage a pillow edge in use.

15. A neck support system, comprising:

a main body pillow having a first face with a first edge and a second edge opposite said first edge, and a second face opposite said first face; and a neck support member, as claimed in claim 1, releasably engaged to said main body pillow.

* * * * *